US011670264B2

(12) United States Patent
May et al.

(10) Patent No.: US 11,670,264 B2
(45) Date of Patent: Jun. 6, 2023

(54) APPARATUS FOR VENTING AIRFLOW IN A BASS DRUM

(71) Applicant: REMO, INC., Valencia, CA (US)

(72) Inventors: James H. May, Valencia, CA (US); Scott Renolds, Valencia, CA (US)

(73) Assignee: REMO, INC., Los Angeles, CA (US)

( * ) Notice: Subject to any disclaimer, the term of this patent is extended or adjusted under 35 U.S.C. 154(b) by 132 days.

(21) Appl. No.: 17/395,181

(22) Filed: Aug. 5, 2021

(65) Prior Publication Data

US 2023/0044226 A1 Feb. 9, 2023

(51) Int. Cl.

| | |
|---|---|
| ***G10D 13/02*** | (2020.01) |
| ***G10D 13/10*** | (2020.01) |
| ***G10K 11/00*** | (2006.01) |
| ***G10H 3/14*** | (2006.01) |

(52) U.S. Cl.

CPC ..... *G10D 13/25* (2020.02); *G10D 13/02* (2013.01); *G10D 13/26* (2020.02); *G10H 3/143* (2013.01); *G10K 11/004* (2013.01)

(58) Field of Classification Search

CPC ..... G10D 13/25; G10D 13/26; G10D 13/02; G10H 3/143; G10K 11/004

See application file for complete search history.

(56) References Cited

U.S. PATENT DOCUMENTS 1,121,909 A * 12/1914 Elkins et al. ..... G10D 13/16 84/411 R
4,168,646 A * 9/1979 May ..... G10H 3/146 84/DIG. 12
4,577,541 A * 3/1986 Edge ..... G10D 13/02 446/418
4,742,753 A * 5/1988 Speed ..... G10D 13/20 84/411 R
4,805,514 A * 2/1989 Billings ..... G10D 13/14 984/151
5,095,796 A * 3/1992 Genna ..... G10D 13/02 84/414
6,121,528 A * 9/2000 May ..... G10D 13/02 84/411 R
6,700,044 B1 * 3/2004 Bencomo, Jr. ..... G10D 13/02 84/411 R
6,927,330 B2 * 8/2005 May ..... G10D 13/02 84/411 R
7,148,413 B2 * 12/2006 May ..... G10D 13/22 84/411 R
7,256,342 B2 * 8/2007 Hagiwara ..... G10H 3/146 84/723
7,291,776 B2 * 11/2007 Dunnett ..... G10D 13/02 84/411 R
7,365,258 B1 * 4/2008 Lombardi ..... G10D 13/02 84/422.1
7,485,791 B2 * 2/2009 Takegawa ..... G10D 13/22 84/411 R (Continued)

*Primary Examiner* — Robert W Horn

(74) *Attorney, Agent, or Firm* — Larry F. Gitlin, Esq.

(57) ABSTRACT

A device integrally joined with the ported opening of a musical bass drum resonant drumhead for regulating the amount of vibrating airflow passing through the inside of a bass drumshell and continuing through the ported opening for effectively controlling undesirable higher frequency drum sounds precipitated by the airflow produced upon the striking of the batter head.

28 Claims, 31 Drawing Sheets

(56) References Cited

U.S. PATENT DOCUMENTS

| | | | | |
|---|---|---|---|---|
| 7,582,820 | B2 * | 9/2009 | Millender, Jr | G10D 13/02 84/411 R |
| 7,659,469 | B2 * | 2/2010 | Belli | G10D 13/02 84/411 R |
| 7,692,082 | B2 * | 4/2010 | Abe | G10D 13/02 84/411 R |
| 7,928,303 | B2 * | 4/2011 | Millender, Jr | G10D 13/25 84/411 R |
| 7,968,780 | B2 * | 6/2011 | Millender, Jr | G10D 13/10 84/411 R |
| 8,735,704 | B2 * | 5/2014 | Buchner | G10D 13/02 84/411 R |
| 8,816,178 | B2 * | 8/2014 | Gelb | G10D 13/02 84/411 R |
| 8,835,734 | B2 * | 9/2014 | Schmidt | G10D 13/02 84/411 R |
| 8,853,514 | B2 * | 10/2014 | Cox, Jr. | G10D 13/02 84/411 R |
| 10,163,426 | B2 * | 12/2018 | Yoshino | G10D 13/02 |
| 10,805,717 | B2 * | 10/2020 | May | H04R 1/2819 |
| 11,367,422 | B2 * | 6/2022 | May | H04R 1/2819 |

* cited by examiner

APPARATUS FOR VENTING AIRFLOW IN A BASS DRUM

BACKGROUND OF THE INVENTION

Field of the Invention

The invention relates generally to the field of musical instruments and, more particularly, to an improved apparatus for venting the airflow moving inside a bass drumshell through a ported opening integrated within the drum's resonant head.

Description of the Prior Art

Bass drums, tom-toms, snare drums, and cymbals are known collectively as a drum or trap set. The bass drum (sometimes called a kick drum) in a drum set configuration includes a batter head (aka batter drumhead) and a resonant head (aka resonant drumhead) covering, respectively, the individual openings formed at either end of the drumshell. The batter head covers the opening of the bass drum where the foot pedal and the beater are positioned for striking the drumhead. The resonant head covering the opposite end reverberates from the air movement inside the drumshell, also known as sympathetic vibrations, which result when the beater strikes the batter head. The resonant drumhead is normally fitted with a solid polyester film, though more commonly a polyester film, with one or more openings or a series of openings for the purpose of venting the vibrating air produced inside the drumshell. The same opening may be used as a pathway to insert a microphone inside the drumshell for the purpose of recording or the amplification of drum sounds or for simply reaching inside the drumshell to adjust any sort of internal muffling item or material placed there, such as a blanket, pillow, and the like.

Different tunings and tensionings of the batter and resonant drumheads produce different harmonics as well as a difference in feel or sensation in the drummer's foot resulting from the rebound of the beater off the batter drumhead, which in turn directly affects the amount and intensity of the reverberating air produced inside the drumshell. When two standard drumheads are used to completely close the openings formed at either end of the drumshell, the air produced inside the drumshell is typically vented through one or more small air vents fabricated in the shell itself, which are usually no more than ½" in diameter each. The vent holes formed in the drumshell allow the film covering both ends to deflect and, thus, produce a more pronounced fundamental pitch or note. Drumshells that are not vented give rise to drumheads that are hard or stiff. This results because of the resonant or front drumhead's inability to deflect for the reason that the air inside the shell is compressed and unable to vent.

To achieve the proper fundamental pitch or note and also the correct level of sensation or feel in the drummer's foot operating the foot pedal, professional drummers and sound engineers will often vary the number and size of the vent holes or ported openings formed in the resonant head. However, this method of venting the head to achieve the proper fundamental pitch or note and the small variations in sound and feel can be a tedious process as the entire drumhead usually must be removed and replaced with a drumhead that includes the requisite number and sizes of the desired vent holes. This requires significant time and effort and having to maintain a sufficient inventory and variety of uniquely vented drumheads. U.S. Pat. No. 9,190,037 (the "'037 Patent") incorporates a means to vary the ventilation of airflow moving through the inside of the drumshell and eventually the ported opening. However, the device taught by the '037 Patent is structurally unsubstantial, relatively flimsy and too often unreliable in its construction. Additionally, the '037 Patent teaches the use of a separate relatively invasive airflow venting device attached to and spread over a large portion of the front side of the resonant drumhead enabling the obfuscation of the manufacturer's or artist's name, logo and/or branding imprinted and normally easily visible on the front surface of the drumhead. Most, if not all, resonant drumheads typically display the name, logo or graphic associated with a particular manufacturer, artist or band for identification and marketing purposes for achieving valuable publicity. Accordingly, it is very important that the logo, branding, and/or associated graphic be entirely visible to the audience.

Recording an accurate bass drum sound for eventual replay or immediate amplification is typically achieved with a microphone positioned either inside the drumshell or on the outside of the shell nearby or in front of the ported opening formed in the resonant head. In some instances, a combination of both set-ups is employed for the intended purpose. Previous methods of installing a microphone inside a bass drumshell include, without limitation, drilling through the drumshell for affixing some type of bracket to the sidewall within to support the microphone and providing proper grommets to accommodate the microphone cord. However, this has always been an unacceptable and crude installation option for many drummers. Alternatively, recordings and amplifications are achieved by utilizing a microphone attached to the end of a boom arm supported by a stand. Using this set-up, the microphone can be positioned just outside or in front of the ported opening or inserted through the ported opening of the resonant drumhead to a position inside the drumshell.

With this in mind, there is a need in the art for a device that is most importantly capable of varying and controlling the ventilation of air flowing inside the drumshell through a ported opening formed within the resonant drumhead as well as to provide a sufficiently large enough opening for a microphone to penetrate inside the drumshell or for a person to reach in and adjust any internal muffling material placed within, while preserving the capacity for the resonant drumhead to display the desired branding, logo or graphic of a particular manufacturer, artist or band.

Thus, until now, and for the reasons stated, nothing in the prior art provides for a device or apparatus that may be installed and fixed to a resonant drumhead with the primary purpose of controlling and adjustably venting the air flowing through the bass drumshell, the result of the beater striking the batter head, through the ported opening to achieve a more pronounced fundamental pitch or note and overall the desired harmonics. Nothing in the prior art teaches the device or apparatus so described which also enables the drummer's foot to feel a more authentic sensation as a consequence of the beater striking the batter drumhead. Moreover, nothing in the prior art provides the means along with other improvements so described to penetrate the resonant drumhead to the space inside the drumshell to adjust any items or materials placed there for the purpose of muffling undesirable drum sounds. Finally, nothing in the prior art can achieve the foregoing objectives while also enabling the unobstructed viewing of the highly significant and valuable company branding, artist or band designation, or any other type of associated desired graphic or logo otherwise and most importantly made visible to the audience on the front side of the resonant drumhead.

SUMMARY OF THE INVENTION

The present invention comprises a musical bass drum, which includes a hollow drumshell having a first opening and a second opening, a batter drumhead covering the first opening and a resonant drumhead having a back side, a front side and a ported opening covering the drumshell's second opening. A counterhoop and requisite hardware are provided to secure the batter drumhead and the resonant drumhead to the bearing edges of their respective openings at either end of the drumshell. Also included is a device integrally joined with the ported opening for regulating the amount of airflow passing through the inside of the drumshell and continuing through the ported opening for controlling undesirable higher frequency drum sounds. The airflow is produced as a result of the drummer's foot compelling the beater attached to the foot pedal to action by striking the batter head.

The integrally joined device comprises a variety of integrated components including a back side plate member having a front side and a back side, the back side having a plurality of fixed spaced-apart boss members and each member having a corresponding opening, a clamping plate member having a back side and a front side, the front side having a plurality of fixed spaced-apart boss members with each of the boss members having a corresponding opening, and a gasket member. A movable door member is positioned and secured in slidable engagement between the back side plate member and the clamping plate member which are then bound together by threaded bolt fasteners secured to their corresponding hex nuts, though other types of fasteners and nuts may also be suitable. The movable door is adapted to be vertically disposed upwardly and downwardly for varying the size of the ported opening and adjusting the amount of airflow passing through. The device is joined with the ported opening by abuttingly positioning it against the back side of the resonant drumhead and fixed and secured there by a clamping ring member, which engages the device from the front side of the resonant drumhead in accordance with the preferred embodiment of the present invention.

Accordingly, it is an object of the present invention to provide a musical bass drum with the means for varying the amount of airflow moving through the bass drumshell and passing through a ported opening formed in the resonant drumhead.

A further object of the present invention is to provide a musical bass drum capable of controlling the ventilation of air passing from inside the drumshell through a ported opening in a resonant drumhead utilizing an apparatus fixed against the inside surface of the resonant drumhead in cooperation with a clamping ring for engaging and securing the apparatus from the front side of the resonant drumhead.

Another object of the present invention is to provide a musical bass drum which includes a movable door positioned between components of the apparatus and secured there in slidable engagement enabling the movement of the door upwardly or downwardly to vary the size of the ported opening and accordingly adjust the venting of the airflow passing through.

Yet another object of the present invention is to provide a musical bass drum with the means to accommodate a microphone inside the drumshell to record or amplify the drum sounds produced within.

A further object of the present invention is to provide a musical bass drum with the means to enable direct and unobstructed access to the area inside the drumshell for adjusting any internal muffling device or material positioned there.

Still another object of the present invention is to provide a musical bass drum with an apparatus attached to the resonant drumhead for varying the amount of airflow passing through the ported opening that does not visually interfere with the branding, name, logo or graphic design associated with a particular manufacturer, band or artist.

Yet another object of the present invention is to provide a musical bass drum with an apparatus for varying the amount of airflow as it moves through the inside of the drumshell and passes through the ported opening with the overall objective of controlling the undesirable higher frequency drum sounds.

Another object of the present invention is to provide a musical bass drum with an apparatus for varying the amount of airflow passing through the inside of the drumshell and through the ported opening that is cost effective to produce and easy to install and operate.

Other objects and advantages of the present invention in all of its embodiments will become apparent in the following specifications when considered in light of the attached drawings wherein the preferred and alternative embodiments of the present invention may be further illustrated.

BRIEF DESCRIPTION OF THE DRAWINGS

FIG. 23 is a perspective view of a conventional musical bass drum demonstrating the effects of film flutter around the peripheral edge of the ported opening as vibrating air passes through.

DETAILED DESCRIPTION OF THE PREFERRED EMBODIMENT

Figure 1:
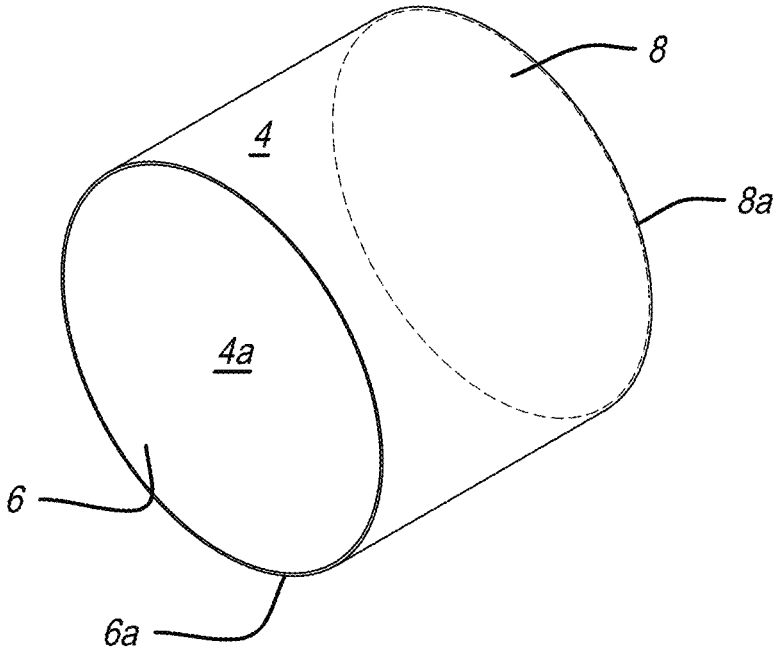
FIG. 1 is a front perspective view of a musical drumshell absent the drumheads, their respective counterhoops and any corresponding hardware.

The present invention will be described in more detail with reference first to FIG. 1, which illustrates a drumshell 4 by itself absent drumheads, counterhoops and hardware. Also shown in FIG. 1 is drumshell interior 4*a*, a first opening 6 with a bearing edge 6*a* and a second opening 8 with a bearing edge 8*a*.

Figure 2:
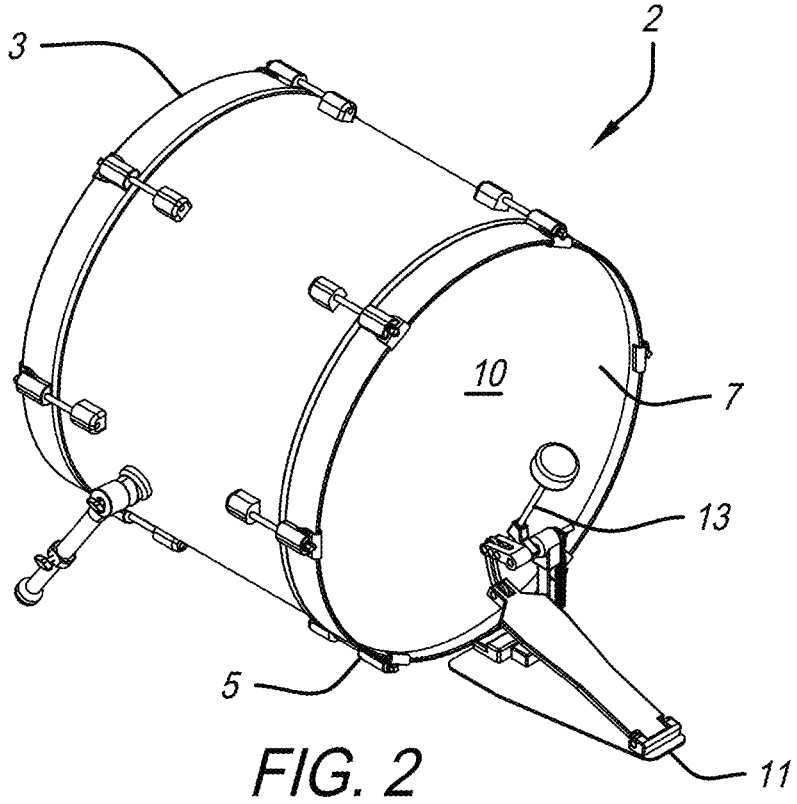
FIG. 2 is a front perspective view of a musical bass drum with a typical foot pedal.
Figure 3:
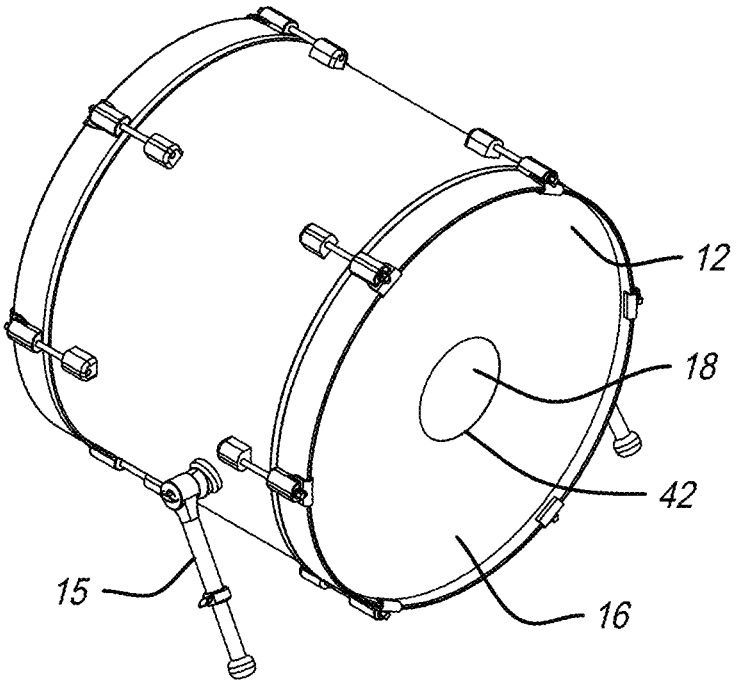
FIG. 3 is a perspective view of a conventional musical bass drum depicting the resonant head with a ported opening in the center.
Figure 4:
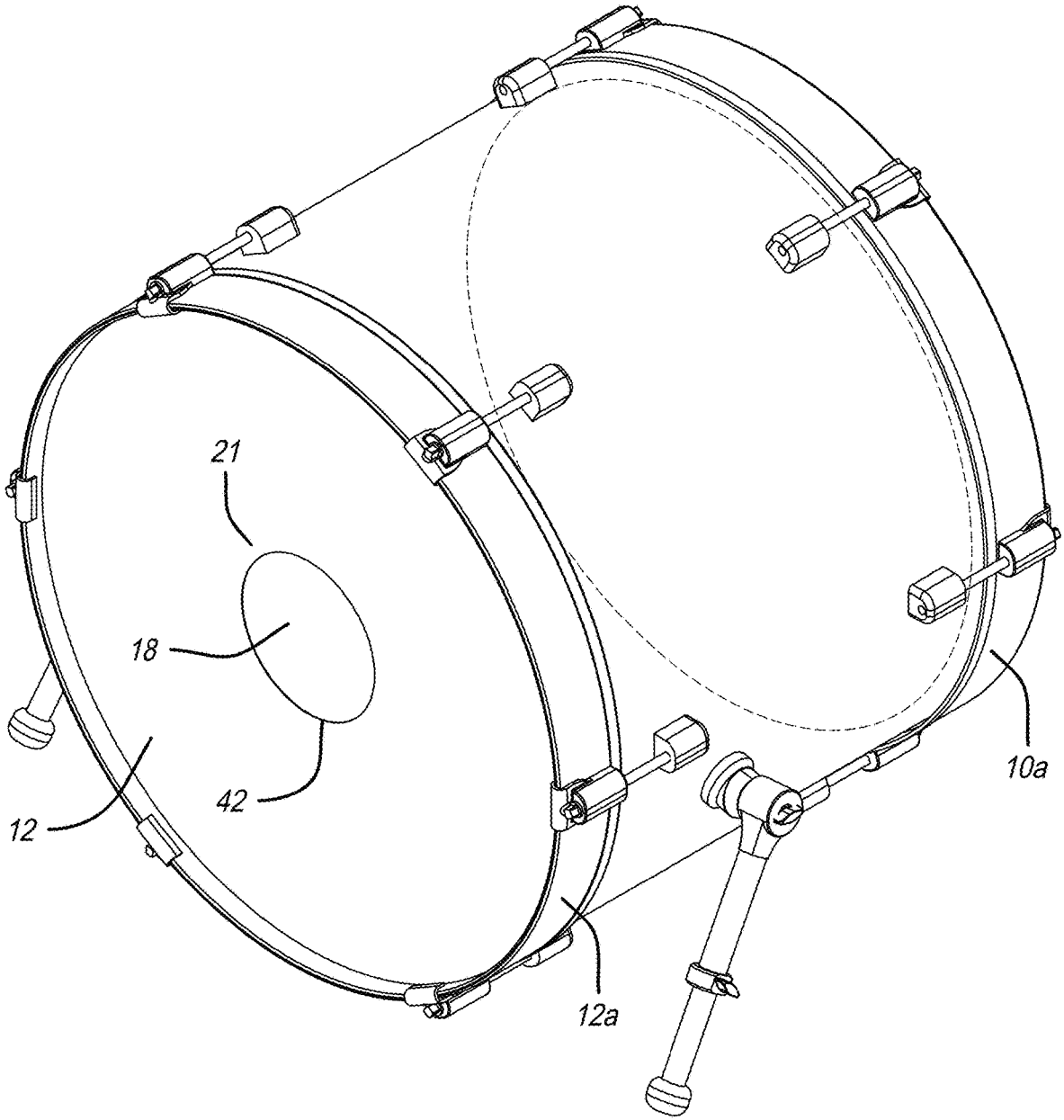
FIG. 4 is an alternative perspective view of a conventional musical bass drum with a ported opening in the center and the back side of the batter drumhead illustrated in phantom.
Figures 5, 5A:
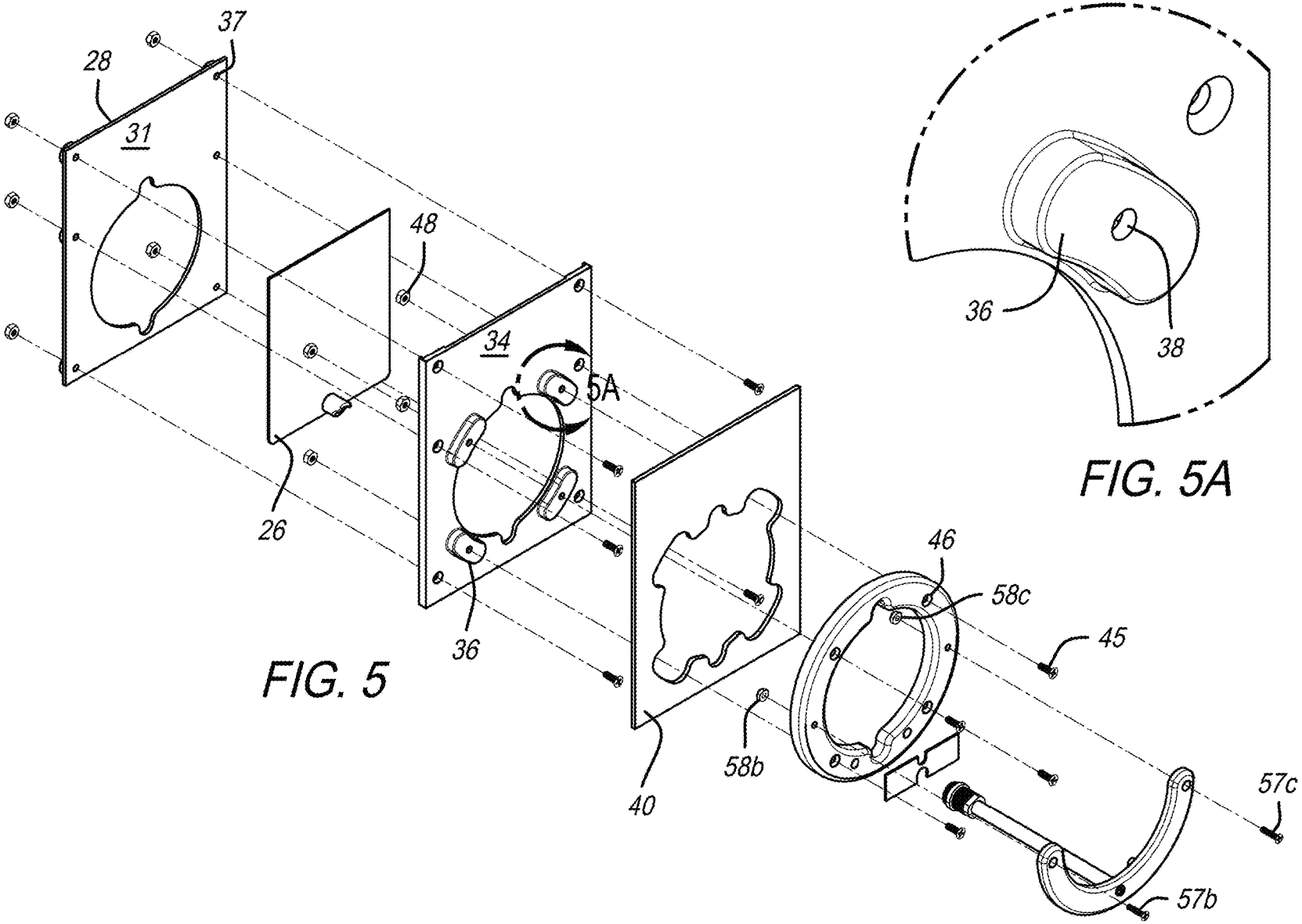
FIG. 5 is a front perspective of an exploded view of the integrated components of the device according to one embodiment of the present invention.
FIG. 5A is an enlarged view of the boss member shown in FIG. 5.
Figure 6:
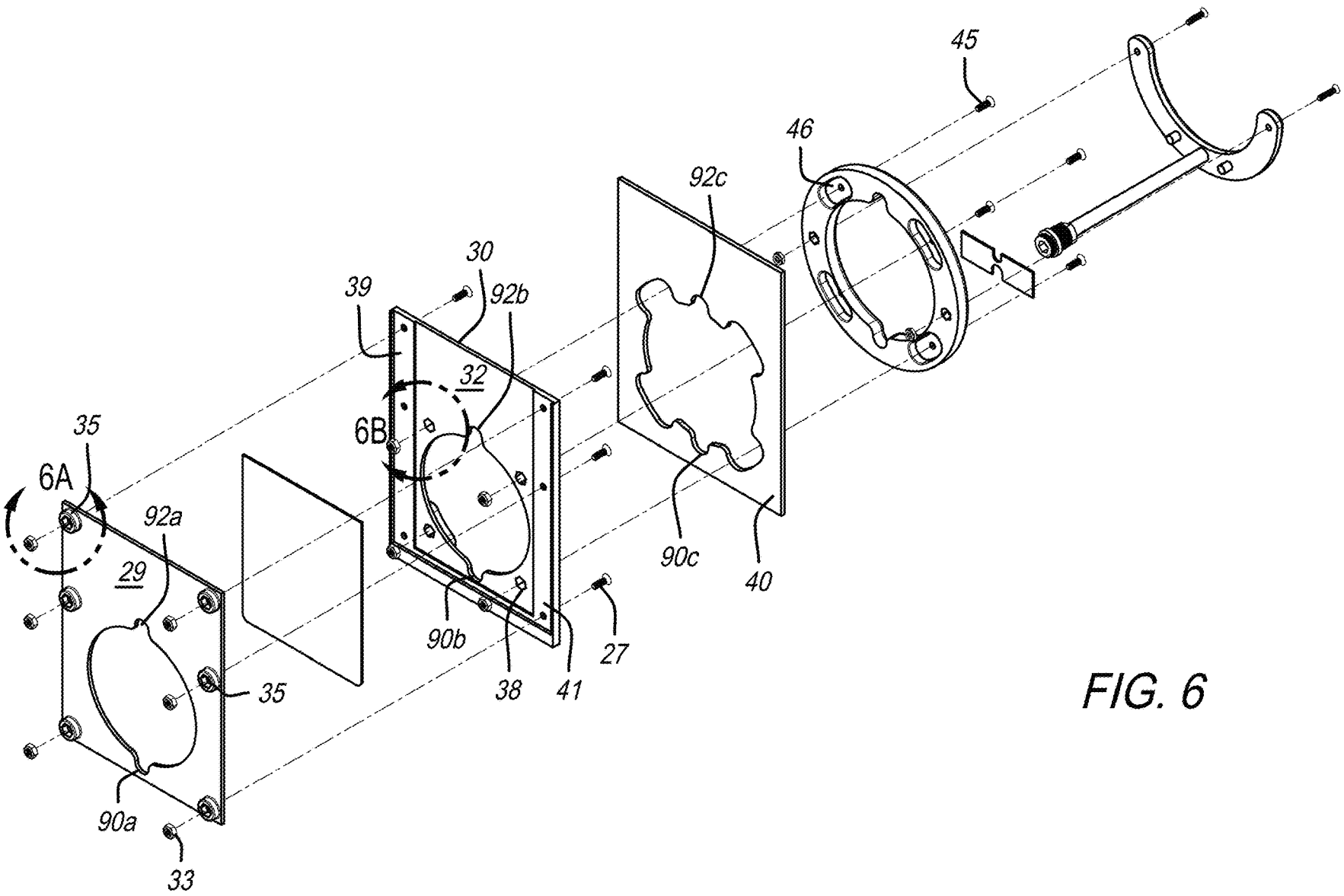
FIG. 6 is a rear perspective of an exploded view of the integrated components of the device according to one embodiment of the present invention.
Figure 6A:
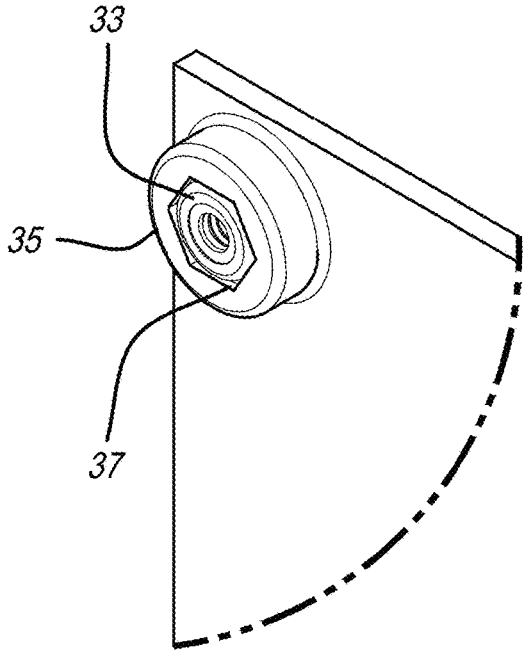
FIG. 6A is an enlarged view of the section of the back side member shown in FIG. 6.
Figure 6B:
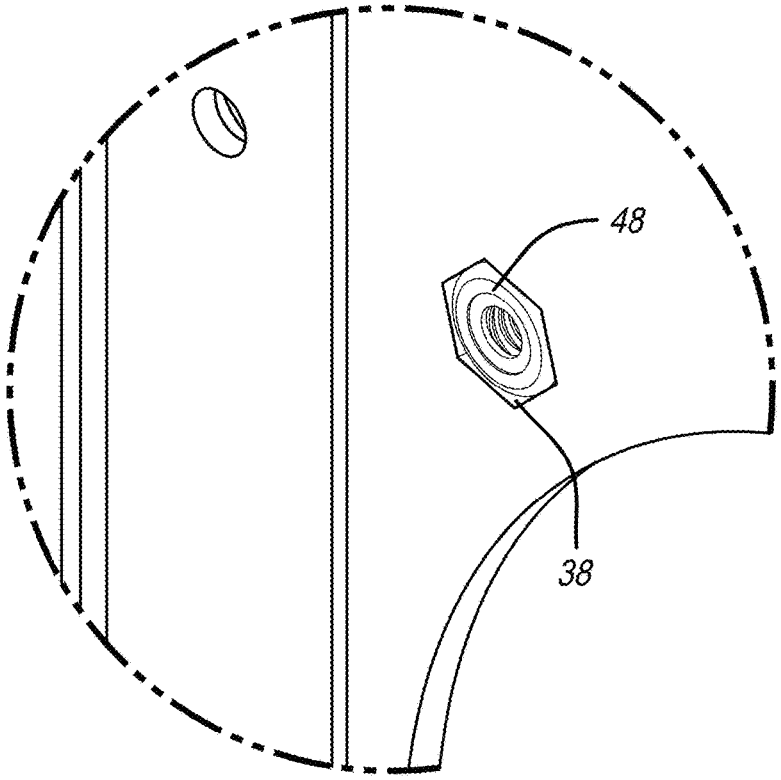
FIG. 6B is an enlarged view of the section of the clamping plate member shown in FIG. 6.
Figure 7:
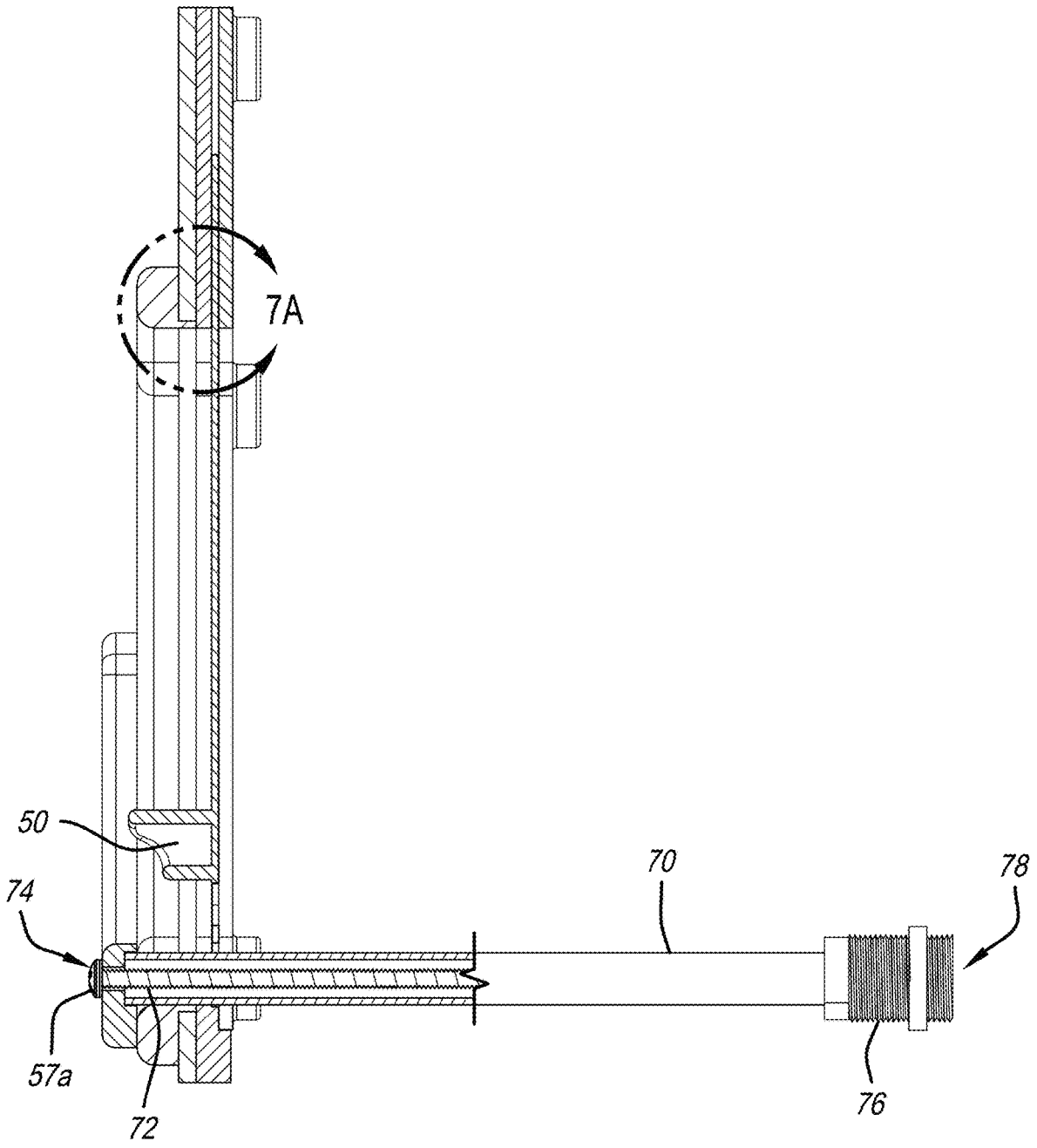
FIG. 7 is a cross-sectional view of the device according to one embodiment of the present invention.
Figure 7A:
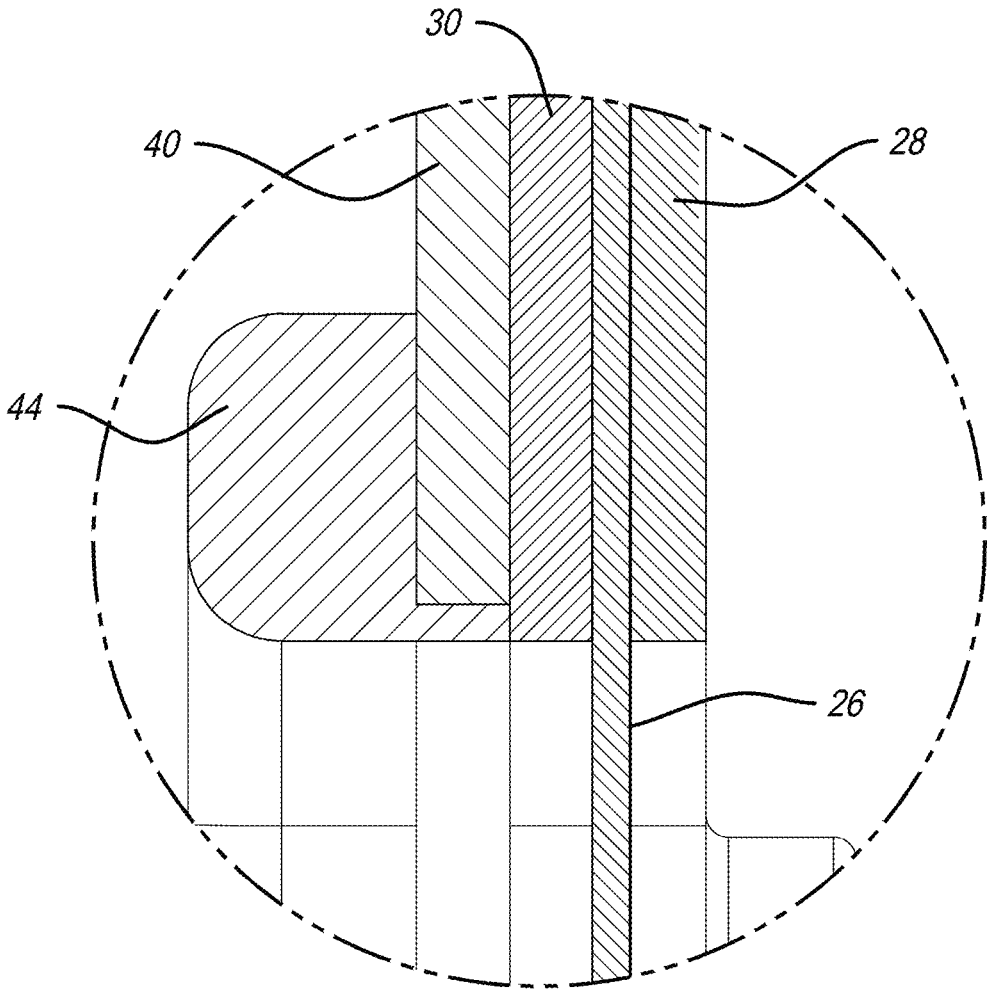
FIG. 7A is an enlarged view of the cross-sectional perspective shown in FIG. 7.
Figure 8:
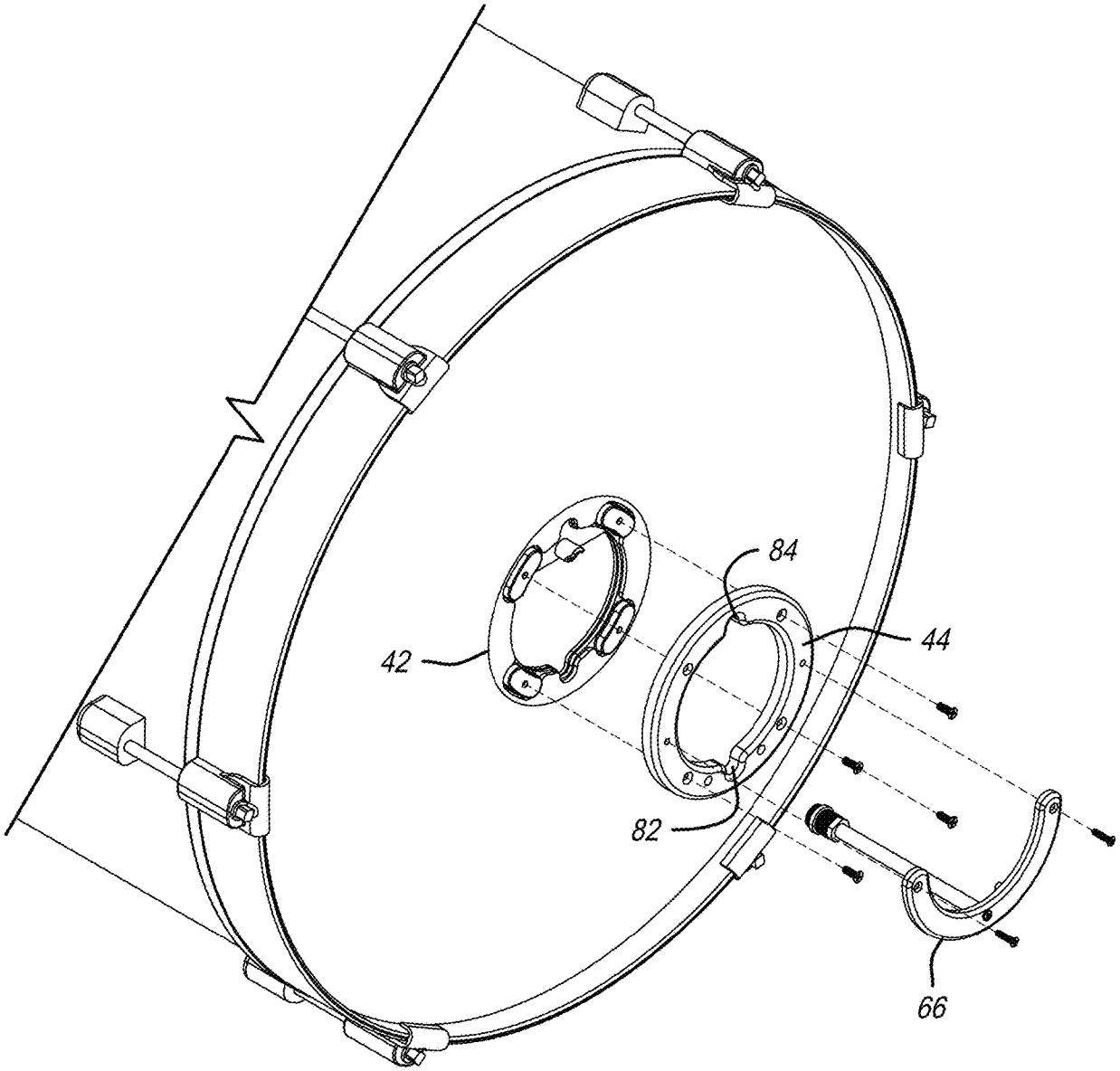
FIG. 8 is an exploded view of the components used to secure the device according to the present invention shown from a perspective forward of the resonant drumhead.
Figure 9:
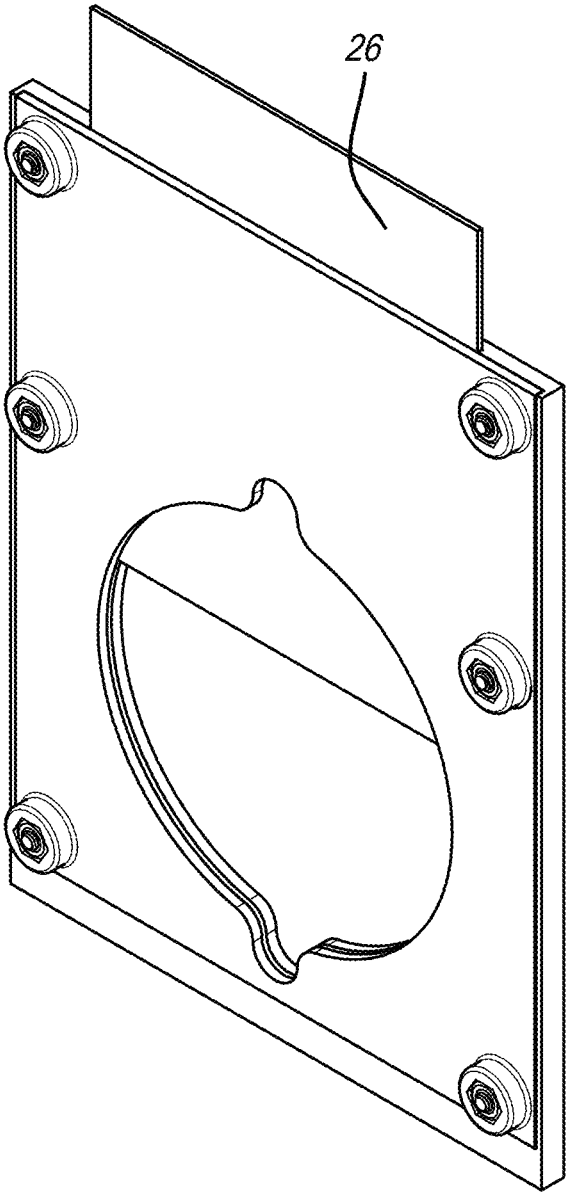
FIG. 9 is a perspective view of one embodiment of the device according to the present invention.
Figure 10:
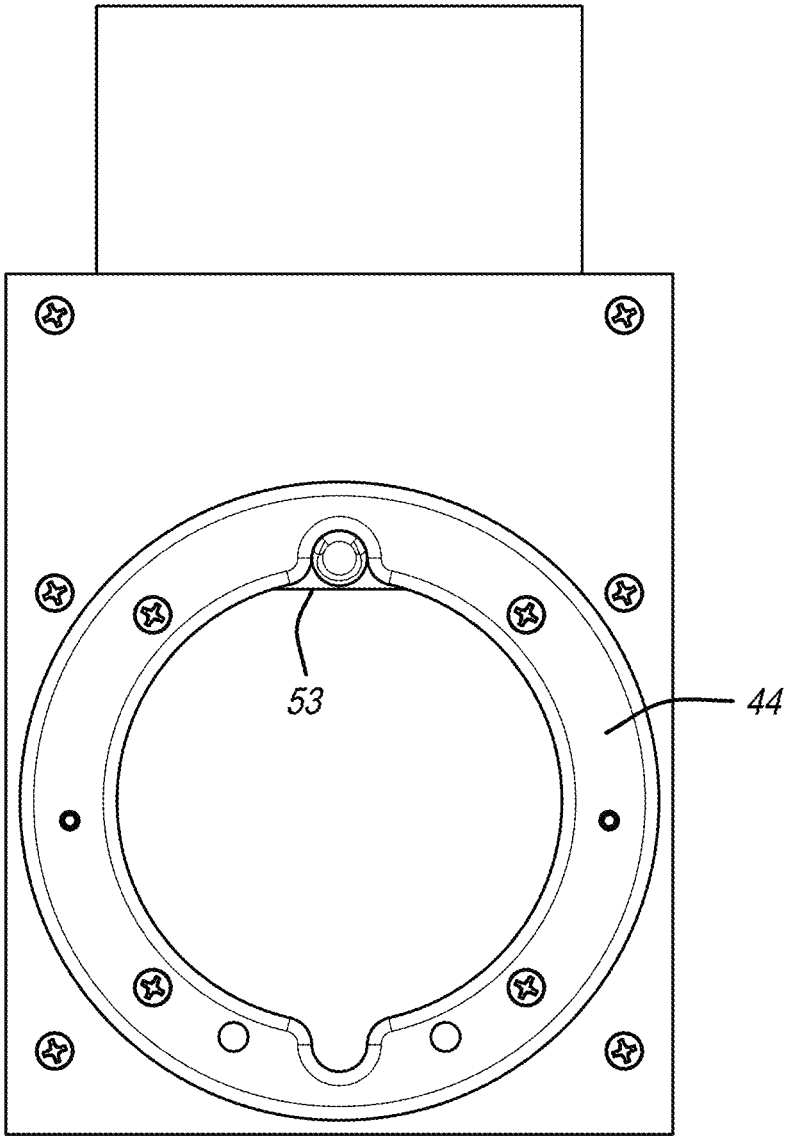
FIG. 10 is an elevated view of one embodiment of the device according to the present invention.
Figure 11:
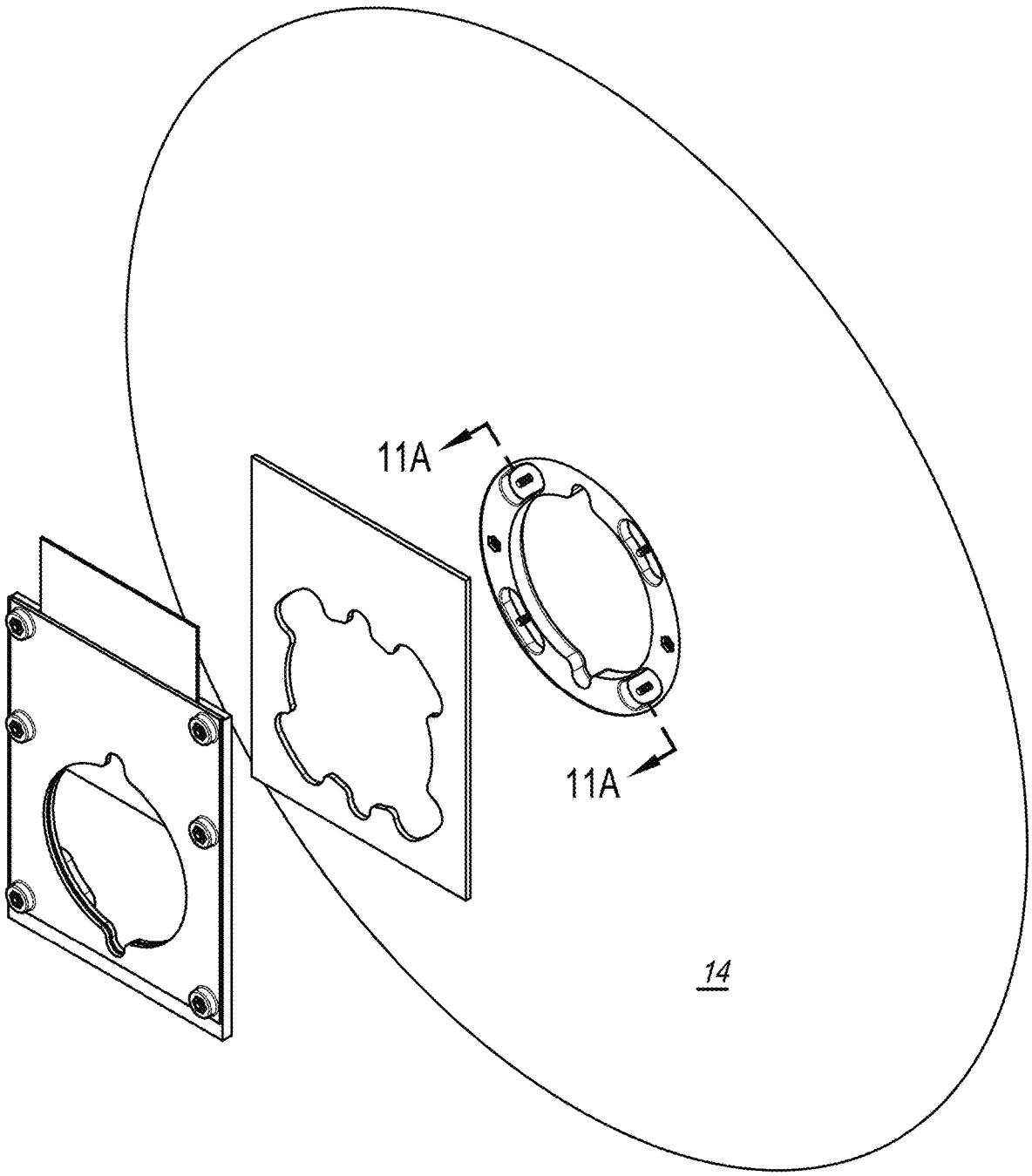
FIG. 11 is a view of one embodiment of the device according to the present invention shown from a perspective rearward of the resonant drumhead.
Figure 11A:
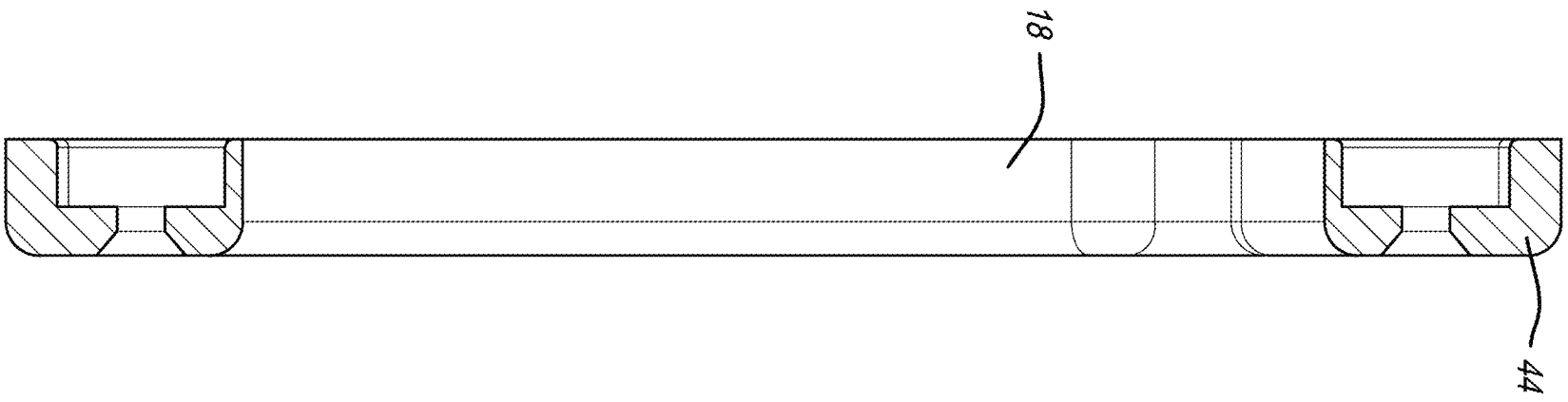
FIG. 11A is a cross-section of one embodiment of the device according to the present invention shown in FIG. 11.
Figure 12:
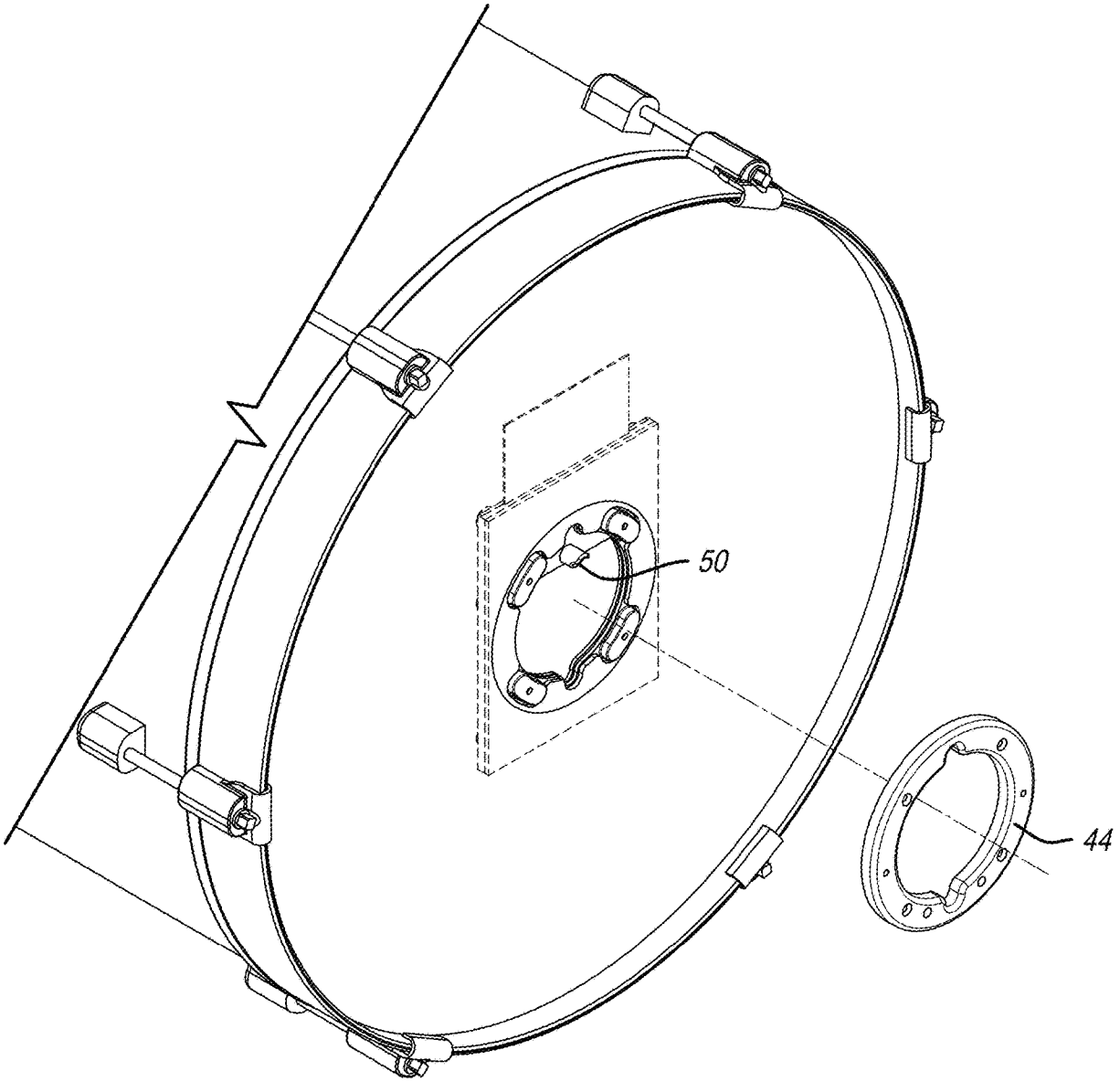
FIG. 12 is a perspective view of one embodiment of the device according to the present invention shown partially in phantom illustrating the intended positioning of the clamping ring member.
Figure 13:
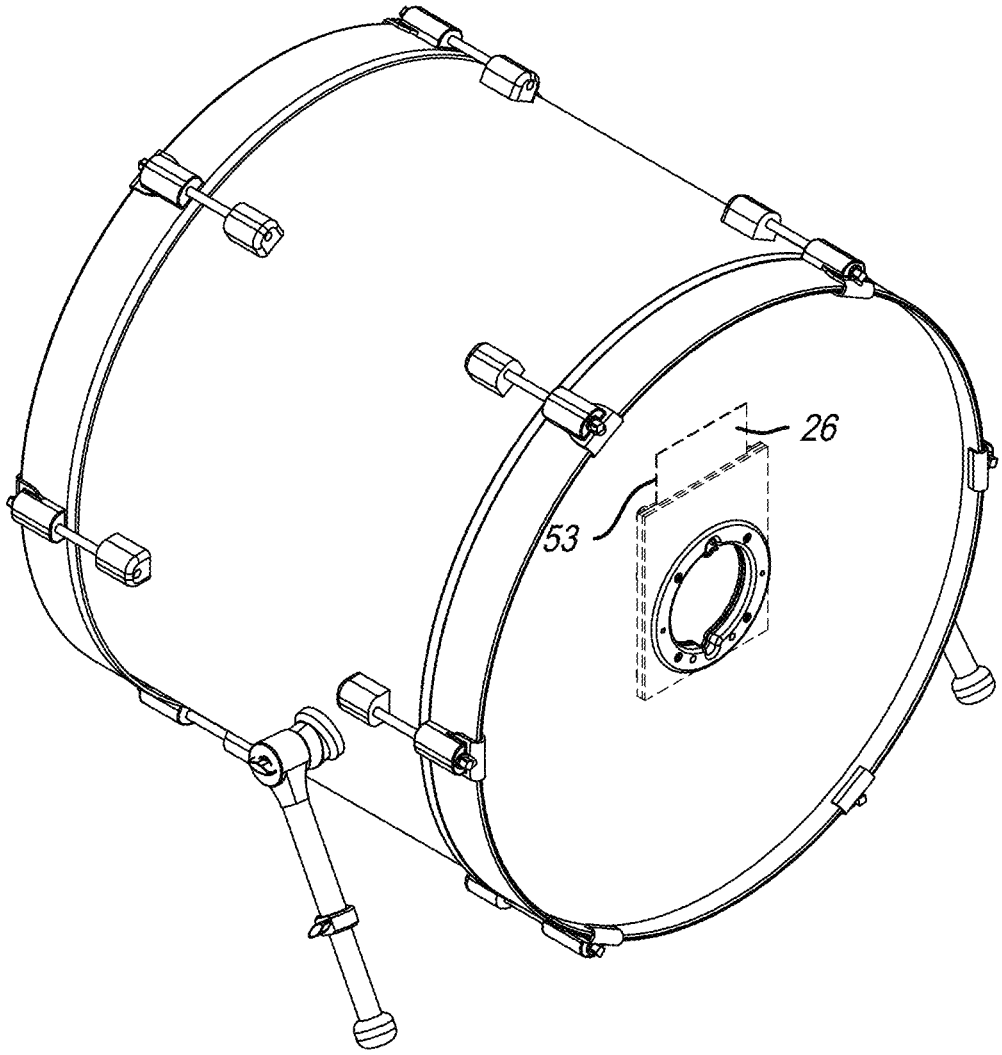
FIG. 13 is a perspective view of one embodiment of the device according to the present invention shown partially in phantom and attached to the resonant drumhead with the movable door component in the raised position.
Figure 14:
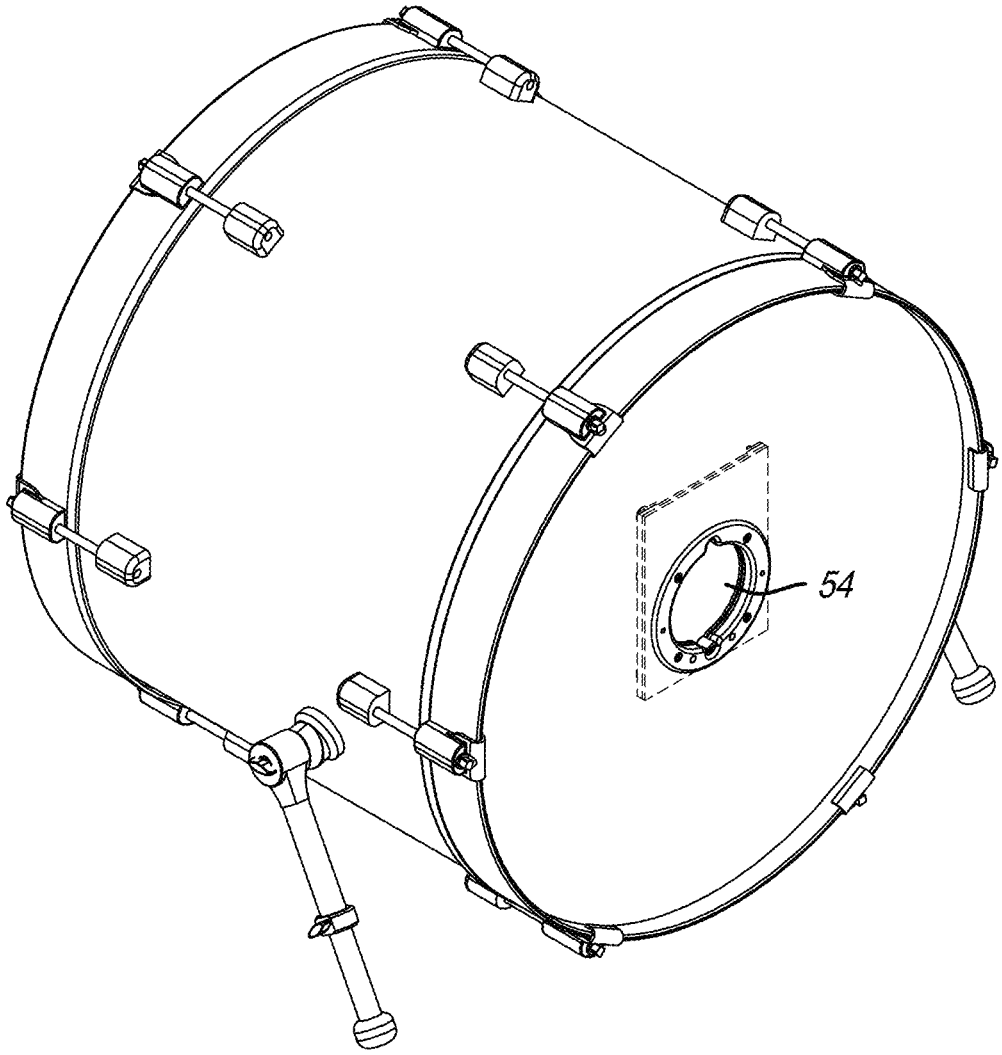
FIG. 14 is a perspective view of one embodiment of the device according to the present invention shown partially in phantom and attached to the resonant drumhead with the movable door component in the lowered position.
Figure 15:
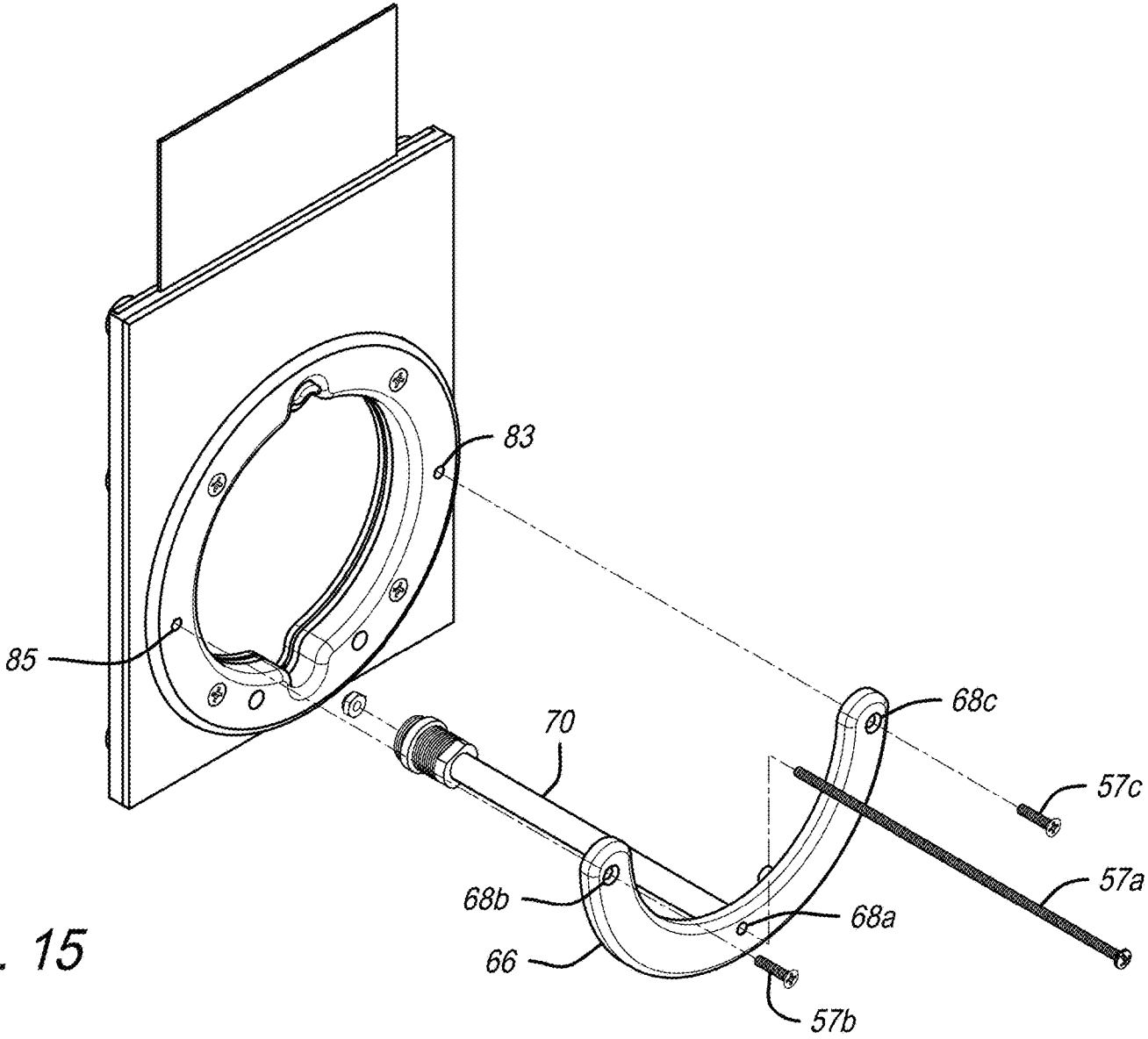
FIG. 15 is a perspective view of one embodiment of the device according to the present invention with the half-ring clamping member and microphone support assembly shown in exploded view.
Figure 16:
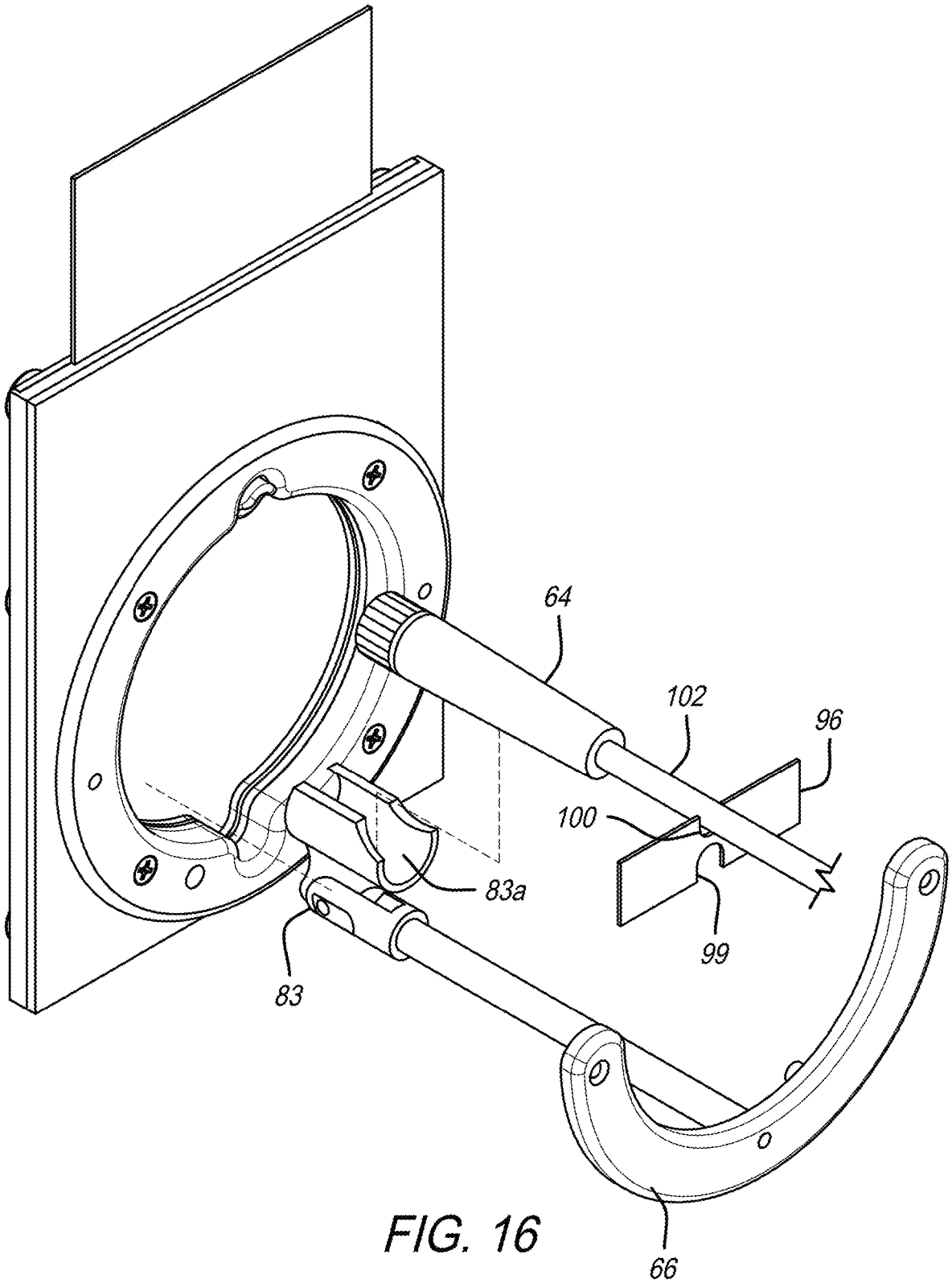
FIG. 16 is a perspective view of one embodiment of the device according to the present invention shown with the half-ring clamping member, microphone support assembly and microphone shown in exploded view.
Figure 17:
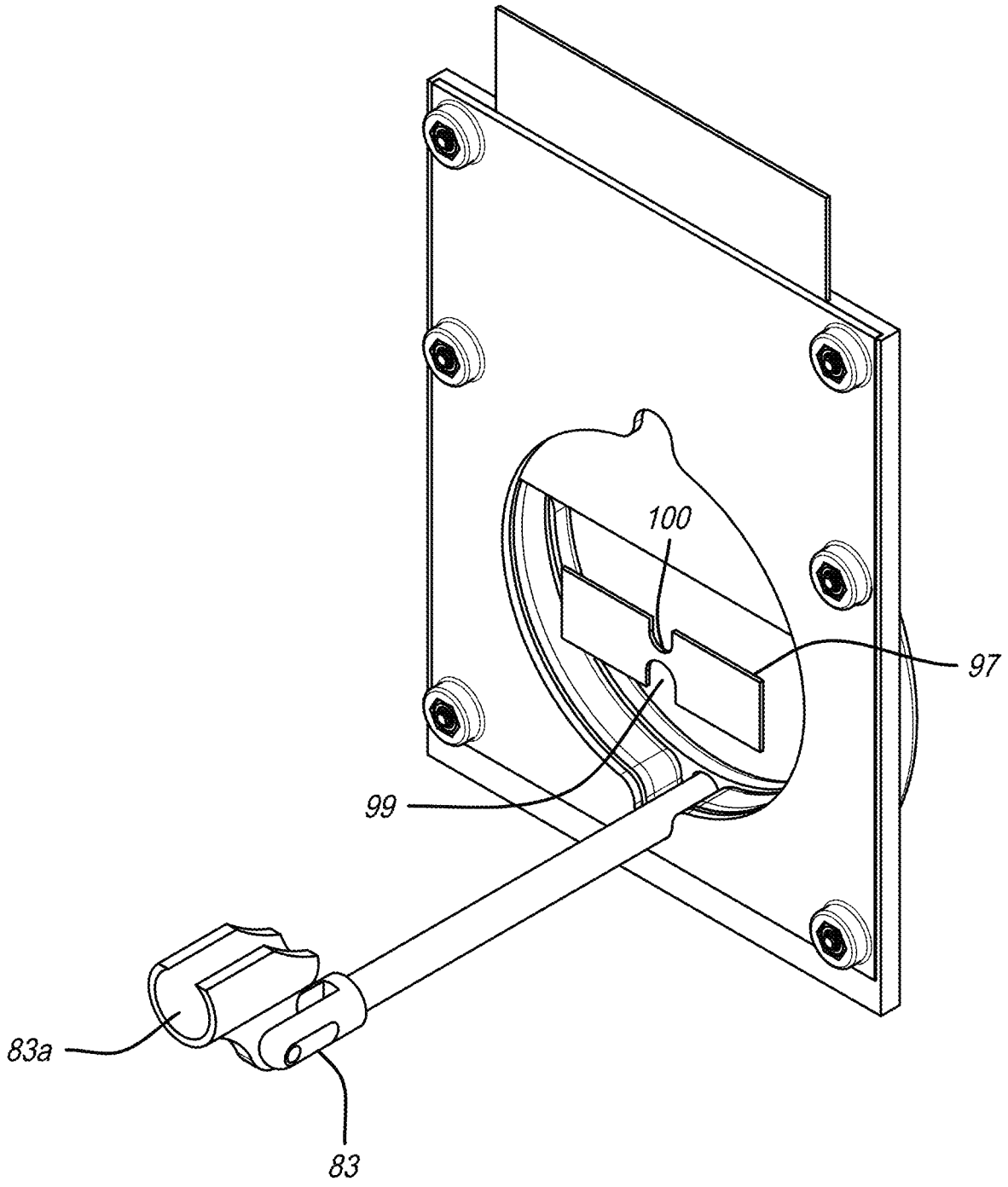
FIG. 17 is a perspective view of one embodiment of the device according to the present invention illustrating the microphone support assembly penetrating the ported opening in the resonant drumhead.
Figure 18:
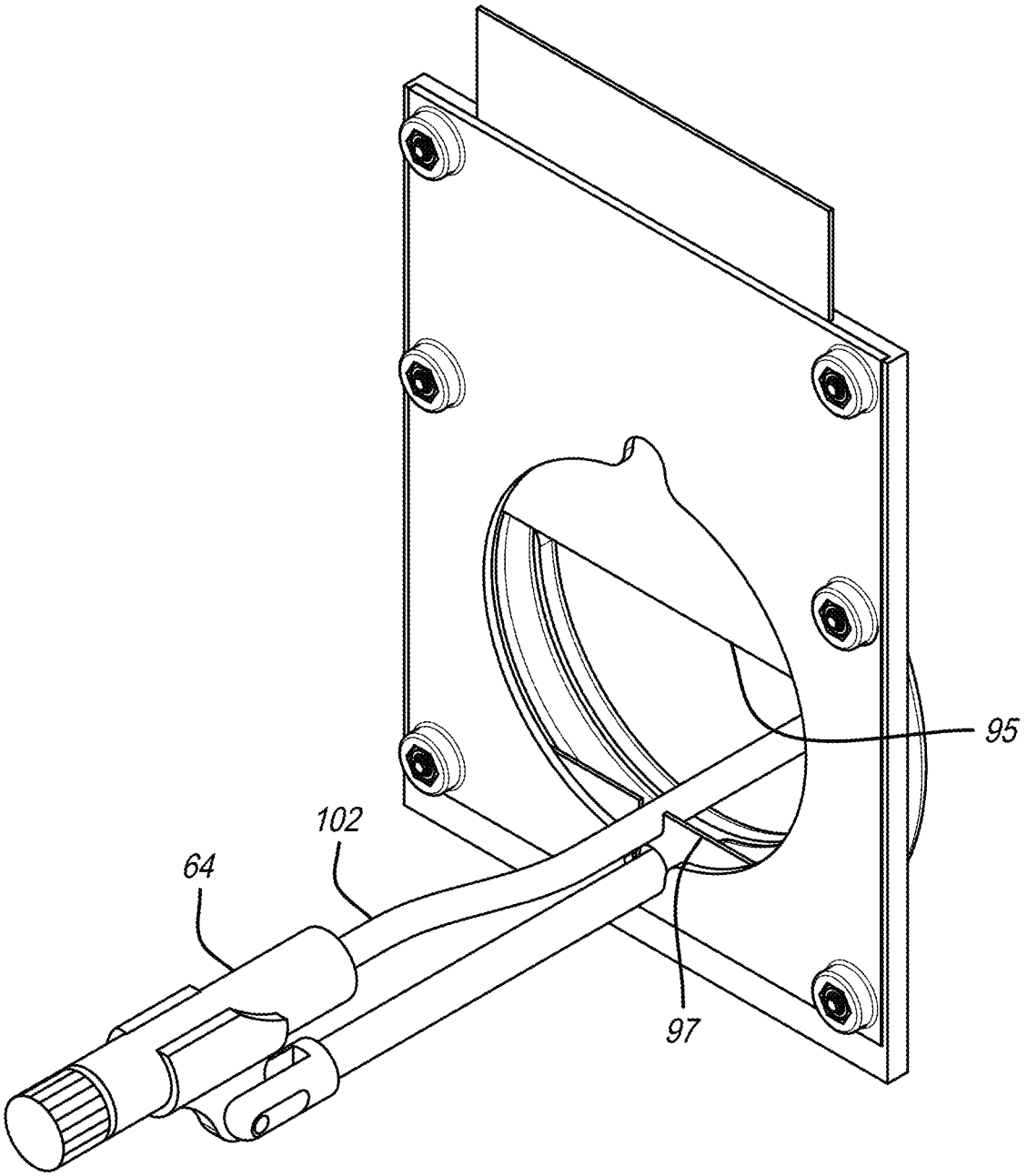
FIG. 18 is a perspective view of one embodiment of the device according to the present invention shown with the microphone and cord supported by the microphone support assembly penetrating the ported opening in the resonant drumhead and the movable door in a partially raised position.
Figure 19:
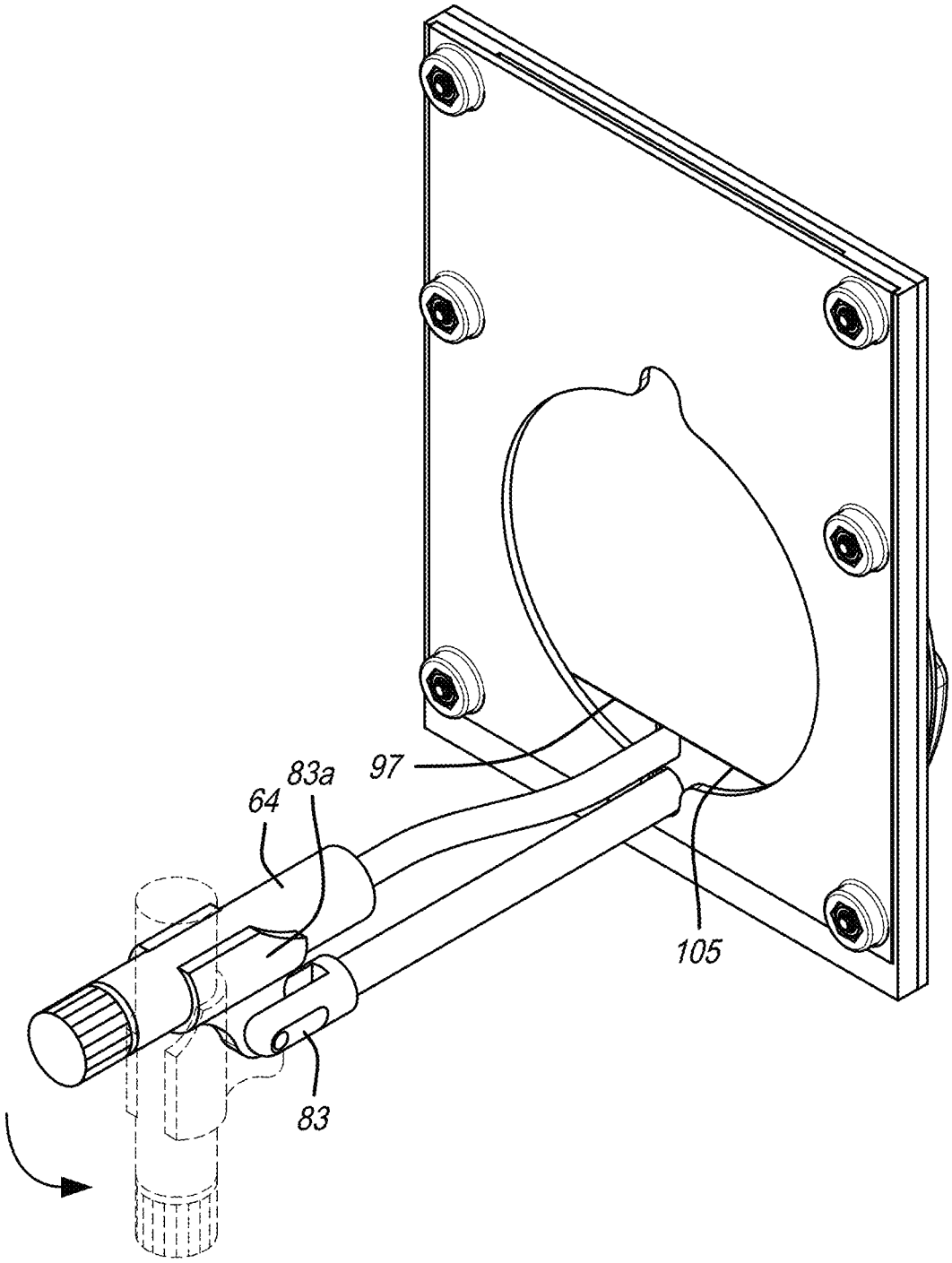
FIG. 19 is a perspective view of one embodiment of the device according to the present invention shown with the microphone and cord supported by the microphone support assembly angled downwardly after penetrating the ported opening in the resonant drumhead.
Figure 20:
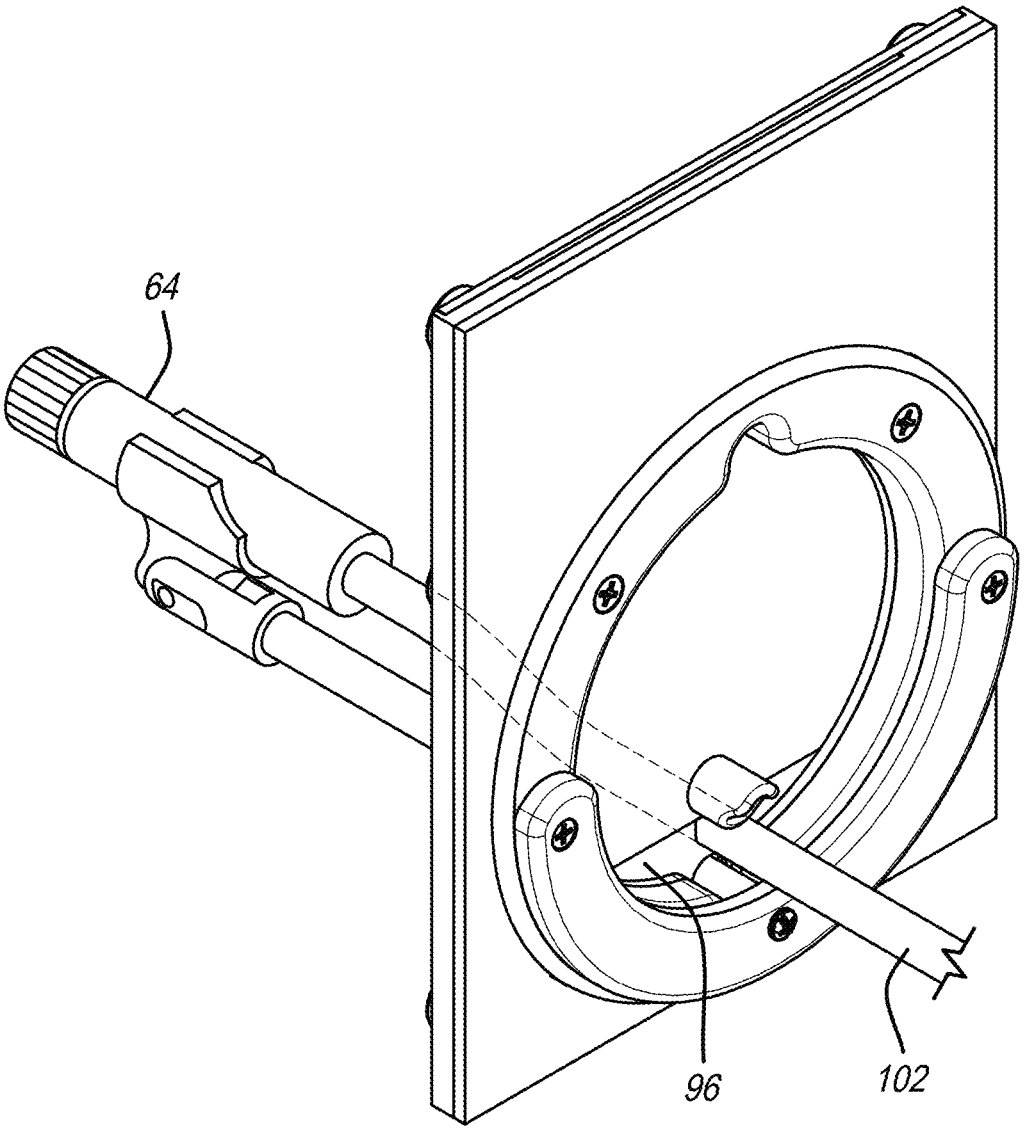
FIG. 20 is a perspective view of one embodiment of the device according to the present invention shown with the microphone support assembly supporting the microphone after penetrating the ported opening.

FIGS. 2 and 3 illustrate musical bass drum 2 having a front end 3 and a back end 5. Also included is batter drumhead 10, which consisting of front side 7 and back side 9 coyers first opening 6. Resonant drumhead 12, which covers second opening 8, includes back side 14, front side 16, and ported opening 18. Securing batter head 10 and resonant drumhead 12 to front end 3 and back end 5, respectively, are counterhoops and corresponding hardware 10*a* and 12*a*. Connected to bass drum 2 and/or positioned before front end 3 of batter drumhead 10 is bass pedal 11 with attached beater 13. Bass drum spurs 15 are also provided for stabilizing drum 2.

Also provided is assembled device 20 for attachment to back side 14 of resonant drumhead 12 for varying and controlling the amount of vibrating air 22 passing within interior 4*a* of drumshell 4 and through ported opening 18. Vibrating air 22 is produced when pedal 11 is depressed, compelling beater 13 to strike and forcibly deflect batter head 10. Device 20, which is used for regulating the amount of vibrating air 22 that passes through ported opening 18, is designed to integrally join and bond with ported opening 18 for this purpose. Device 20 has a movable door member 26 which is adapted to be vertically disposed upwardly and downwardly for varying the size of ported opening 18. The culmination of all these actions results ultimately in the control and, as desired by the drummer, the elimination of most, if not all, of any undesirable higher frequency drum sounds.

More specifically, device 20 consists of an assembly of integrated components, which include back side plate member 28, having a front side 31 and a back side 29 with a plurality of spaced-apart boss members 35. Also provided is clamping plate member 30, having a back side 32 and a front side 34 including a plurality of spaced-apart boss members 36, and gasket member 40. Each boss member 35 includes a corresponding opening 37 and each boss member 36 includes a corresponding opening 38. Movable door member 26 is secured between back side plate member 28 and clamping plate member 30 along guide tracks 39, 41 formed within back side 32 of clamping plate member 30 in slidable engagement.

Back side plate member 28 and clamping plate member 30 are secured by a means for controlling the amount of slide tension applied to movable door member 26 as movable door member 26 is raised or lowered along guide tracks 39, 41 between back side plate member 28 and clamping plate member 30 enabling the movement of door member 26 to control the amount and intensity of airflow 22 passing through ported opening 18. Means for controlling the amount of slide tension includes, for example, a plurality of engaged threaded bolt fasteners 27 utilized to fasten clamping plate member 30 to back side plate member 28, which, when paired with nuts 33, combine to either tighten or loosen the connection between back side plate member 28 and clamping plate member 30 consequently affecting the amount of slide tension impacting the vertical movement of movable door member 26. Each boss member 35 of back side plate member 28 has a corresponding opening 37. Clamping plate member 30 includes a plurality of openings 38 inside corresponding boss members 36, each opening 38 being adapted to receive threaded bolt fasteners 45 through opening 46 in clamping ring member 44 to engage corresponding opening 38. This, when paired with a corresponding nut 48, causes clamping plate member 30, which is connected to back side plate member 28 with movable door 26 in between, and clamping ring member 44 joined to form a permanent connection with ported opening 18 positioned in between.

Device 20 is joined with ported opening 18 and abuttingly situated against back side 14 of resonant drumhead 12 with boss members 36 positioned to engage rim 42 of ported opening 18 for centering and aligning device 20 in substantially vertical relation relative to ported opening 18. Device 20 is then secured to resonant drumhead 12 by clamping ring member 44, which is adapted to engage device 20 from front side 16 of resonant drumhead 12. Clamping ring member 44 includes a plurality of openings 46 for receiving threaded bolt fasteners 45 for engaging corresponding nuts 48 and affixing device 20 to resonant drumhead 12.

Also provided is projection member 50 integrally formed with movable door member 26 to shift movable door member vertically between back side plate member 28 and clamping plate member 30. Consistent with the primary objective of the present invention, the incremental vertical movement of movable door member 26 will vary the amount of vibrating air 22 vented through ported opening 18. When operating in a completely opened position 53, movable door member 26 allows the venting of most, if not all, of vibrating air 22 attempting to pass through ported opening 18. Movable door member 26, when operating in a completely closed position 54, inhibits, if not entirely prevents, the venting of vibrating air 22 through ported opening 18.

Microphone 64 suitable for use consistent with the application and objectives of the present invention include, without limitation, Shure models SM 57, Beta52 and AKG D-112. A device for mounting microphone 64 to operate in conjunction with the preferred embodiment of the present invention includes, among many alternatives, half-ring member 66 having at least three openings 68*a*, 68*b*, 68*c* and microphone support rod member 70 attached to tilter assembly 83. Through opening 68*a* in half-ring member 66 is placed a threaded fastener 57*a* for engagement with a threaded opening 72 formed within rod member 70. Through openings 68*b*, 68*c* in half-ring member 66 are placed corresponding threaded fasteners 57*b*, 57*c*, respectively, for engagement with corresponding openings 81, 85 formed within clamping ring member 44. Threaded fasteners 57*b*, 57*c* are paired with corresponding nuts 58*b*, 58*c* for securing half-ring member 66 to clamping ring member 44. All means to fasten or secure the various components of the device of the present invention to resonant drumhead 12 may include, other than those already described herein, any suitable fastening or securement means with or without threads for this purpose.

Microphone support rod member 70, which includes a threaded opening 72 at one end 74 and a threaded portion 76 formed circumferentially at end 78, connects with a mateable threaded portion (not shown) incorporated into tilter assembly 83. Support rod member 70 and tilter assembly 83 may also be connected using any other suitable means for this purpose.

Clamping ring member 44 also includes a first notch 82 for slidably receiving support rod member 70, and a second notch 84. Once in place and secured microphone support rod member 70 in combination with half-ring member 66, to which support rod member 70 is attached, are sufficiently secured to ensure support for microphone 64, more particularly, to prevent microphone 64 from any disruptive shaking, rattling or other kind of movement resulting from beater 13 striking batter drumhead 10 or the effect of vibrating air 22 passing through drumshell interior 4*a* of drumshell 4 and ported opening 18. When placed within interior 4*a* of drumshell 4, microphone 64 finds further support from tilter assembly 83 coupled with support sleeve 83*a* together enabling microphone 64 to rotate upwardly or downwardly to adjust the drum sound vibration pick-up capability of microphone 64.

Back side plate member 28, clamping plate member 30 and gasket member 40 include upper-positioned notches 90*a*, 90*b*, 90*c*, respectively, and lower-positioned notches 92*a*, 92*b*, 92*c*, respectively, which are adapted to align in corresponding relation with first notch 82 and second notch 84 of clamping ring member 44 to enable, among other objectives, microphone support rod member 70 to pass unobstructed through ported opening 18 within drumshell interior 4*a* of drumshell 4. Second notch 84 also serves as a niche into which projection member 50 may be situated and held when movable door member 26 is raised to its max.

Also provided is a shim member 96 having a lower-positioned first notch 99, and upper-positioned second notch 100 and top bearing edge 97 for insertion, when appropriate, between back side plate member 28 and clamping plate member 30. First notch 82 of clamping ring member 44 disposed in alignment with lower-positioned first notch 99 and lower-positioned notches 92*a*, 92*b*, 92*c* are adapted to receive rod member 70 to facilitate the entry of rod member 70 through ported opening 18 with or without microphone 64. Similarly, first notch 82 of clamping ring member 44 in alignment with upper-positioned second notch 100 and lower-positioned notches 92*a*, 92*b*, 92*c* are adapted to receive microphone cord 102 employed for connecting microphone 64 to a source to record or amplify drum sounds (not shown). Shim member 96 is utilized for the purpose of enabling movable door member 26 to close ported opening 18 as completely as it can to corral airflow 22 within drumshell interior 4*a* of drumshell 4 and ensuring the proper positioning of and support for rod member 70 and cord 102. To accomplish this, movable door member 26 is lowered until the bottom edge 95 of movable door member 26 contacts and rests firmly upon the top bearing edge 97.

Accordingly, when rod member 70 and microphone cord 102 are secure in their respective positions within drumshell interior 4*a* of drumshell 4, shim member 96 will enable the maximum amount of air containment within drumshell interior 4*a* of drumshell 4 when ported opening 18 is closed or at least substantially so. Another means for supporting microphone 64 within drumshell interior 4*a* of drumshell 4 includes the use of a conventional boom arm 104 supported by floor stand 105 positioned in front of resonant drumhead 12, or any other type of floor stand suitable for this purpose. Alternatively, the prior art teaches a bracket assembly 107 fixedly secured to the inside wall 108 of drumshell 4 for holding microphone 64 in place. Cord 102 is threaded through opening 109 providing cord 102 a pathway within drumshell 4 to enable a connection with microphone 64. A grommet 110 may be inserted into opening 109 to secure cord 102 and protect it from damage.

Historically, high-frequency film flutter is problematic when ported opening 18 is not evenly tensioned, especially around the perimeter rim 106 of ported opening 18. More specifically, relatively loosely-tensioned film 19 formed around perimeter rim 106 of ported opening 18 is inherently unstable when airflow 22 passes through resulting in unwanted drum sounds. The present invention serves to minimize, if not entirely preclude, high-frequency film flutter along with the predictably annoying and disruptive associated drum sounds. More specifically, the combined weight of device 20 and clamping ring member 44 in addition to their other functions assist in maintaining sufficient tension on film 19 surrounding perimeter rim 106 of ported opening 18.

Also helping to reduce the negative effect of film flutter is gasket member 40, which presses against back side 14 of resonant drumhead 12, more specifically the portion of ported opening 18 most subject to the affects of flutter and closely circumventing perimeter rim 42, namely film 21. In the prior art, these unwanted high-frequency flutter noises can sometimes be controlled with the placement of a filler pillow or something similar (not shown) against back side 14 of resonant drumhead 12. However, this means for controlling flutter noises or unwanted high-frequency sounds is a relatively crude alternative when compared to the much more effective and sophisticated capability of the device of the present invention.

Though not exclusive, the typical dimensions for back side plate member 28 and clamping plate member 30 range between 5.75 inches and 6.25 inches in width and 7 inches and 7.5 inches in height. The typical thickness of both plate members is ¼ of an inch. The approximate dimensions of gasket member 40 are the same. The approximate dimensions of movable door member 26 range between 4.25 inches and 4.5 inches in width, 5 inches and 5.25 inches in height and 1/32 of an inch in thickness. Clamping ring member 44 has an approximate interior diameter of 4 inches and an approximate outer diameter of 5.75 inches and with an approximate thickness of 7/16 inches. Half-ring member 66 is about half the size of clamping ring member 44 and approximately the same thickness. None of the foregoing dimensions needs to be strictly adhered to if circumstances and other factors dictate otherwise.

Materials appropriate for the construction of back side plate member 28, clamping plate member 30 and movable door member 26 include, without limitation, polyethylene, an ABS thermoplastic polymer in particular, or a metal alloy. Materials appropriate for the construction of gasket member 40 include, without limitation, foam, rubber, or any other suitable natural or synthetic substance.

Figure 21:
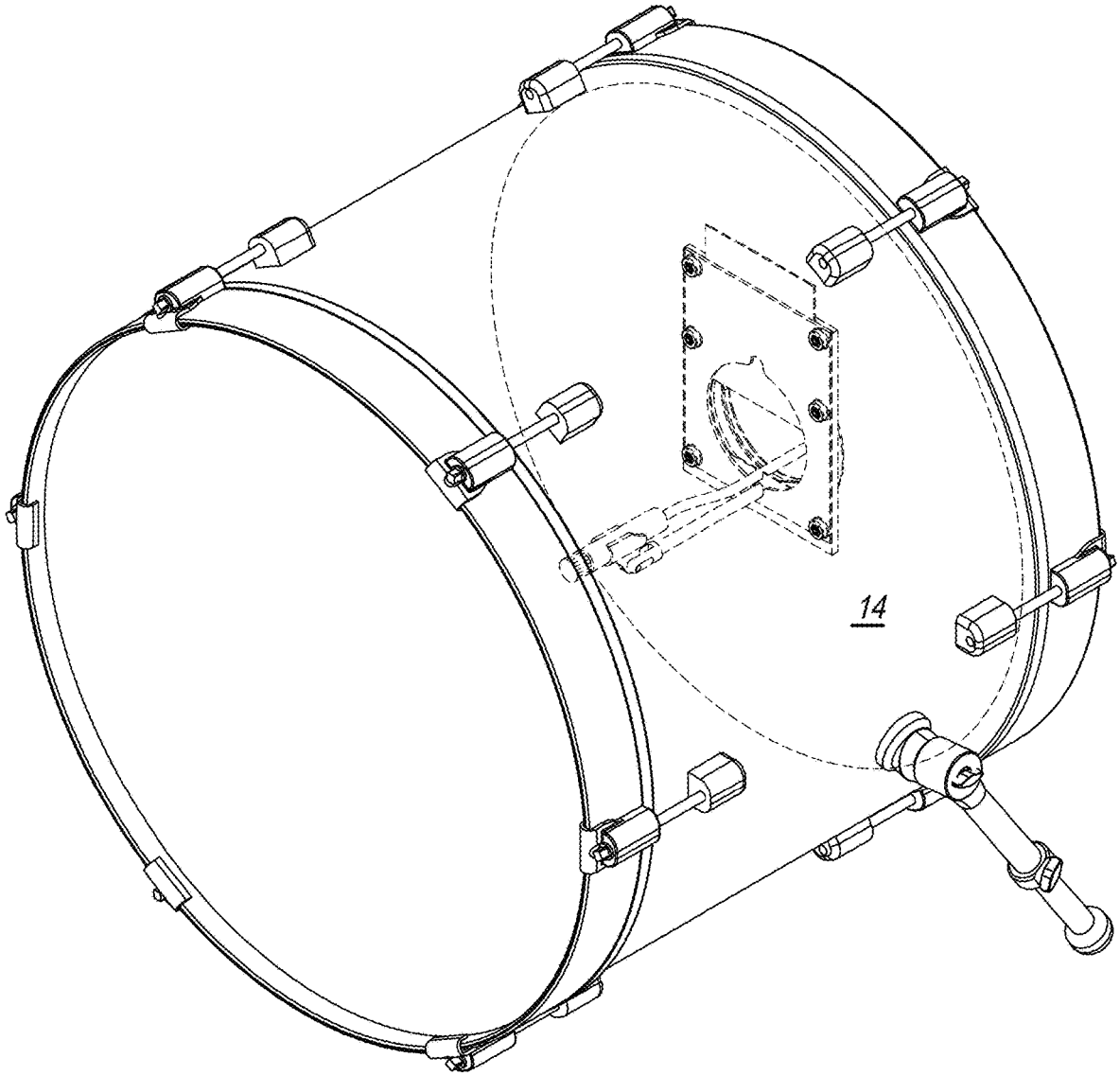
FIG. 21 is a perspective view of one embodiment of the device according to the present invention with the microphone support assembly and microphone shown in phantom inside the drumshell.
Figure 22:
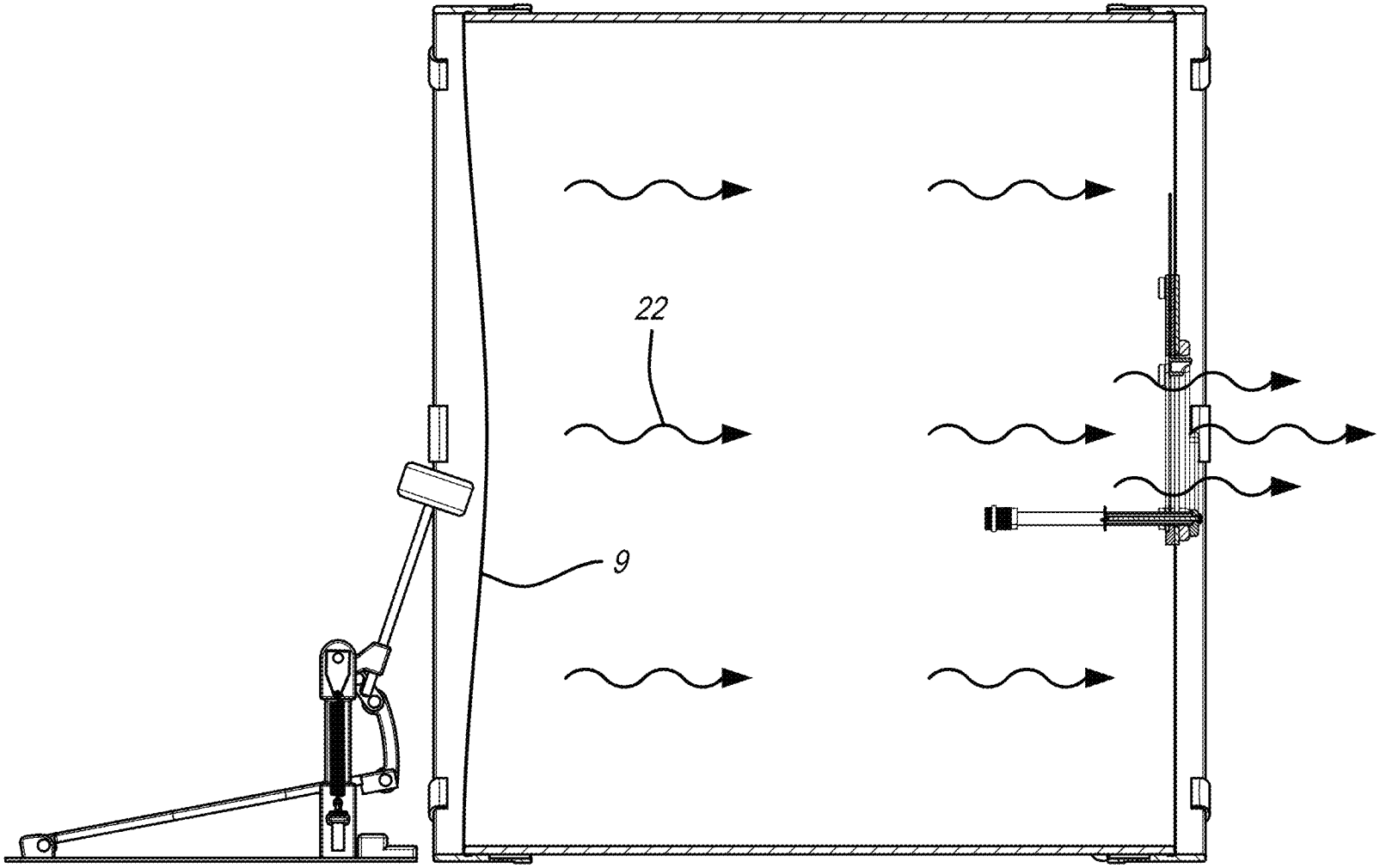
FIG. 22 is a cross-sectional view of one embodiment of the device according to the present invention shown attached to the resonant drumhead and vibrating airflow depicted inside the drumshell passing through the ported opening.
Figure 23:
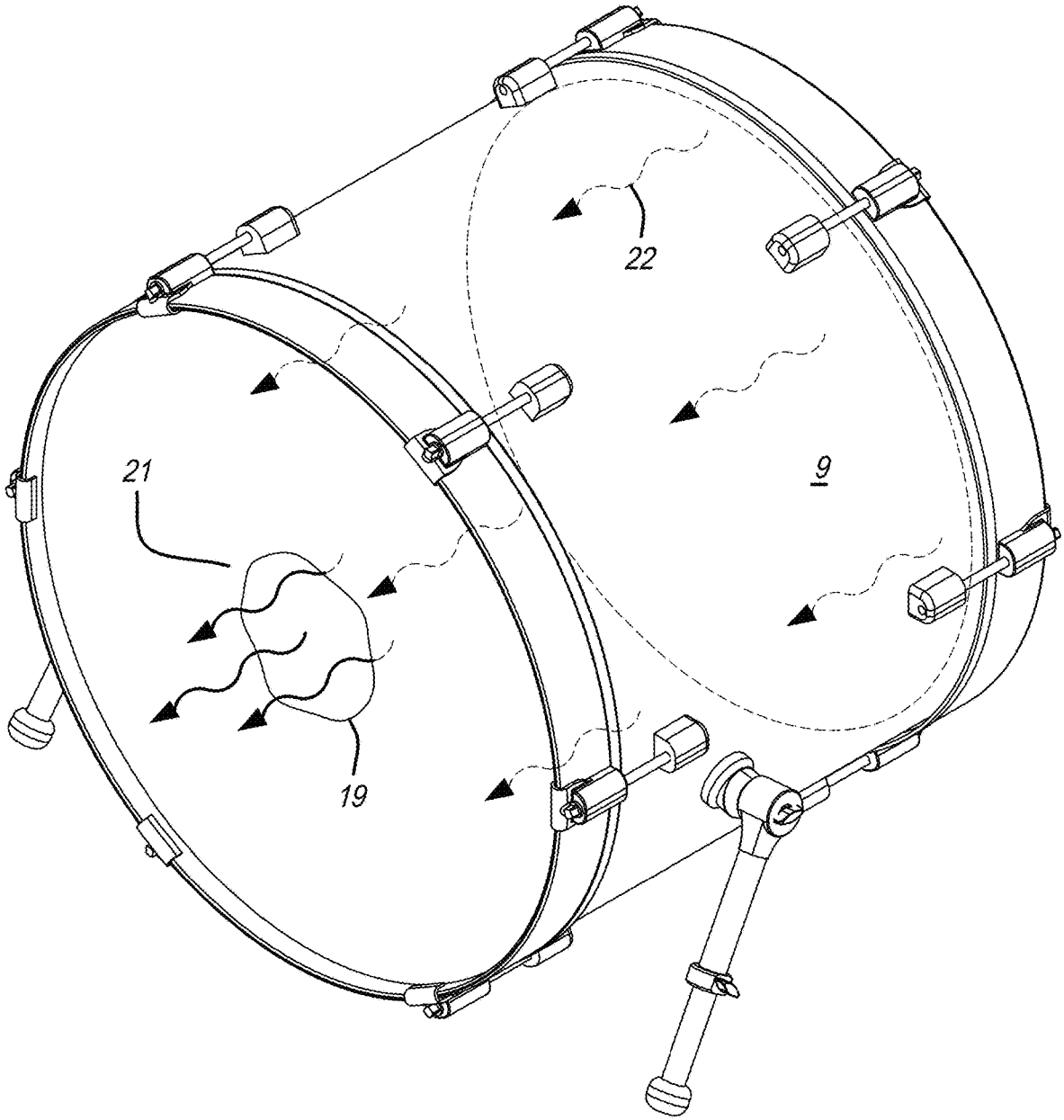
Figure 24:
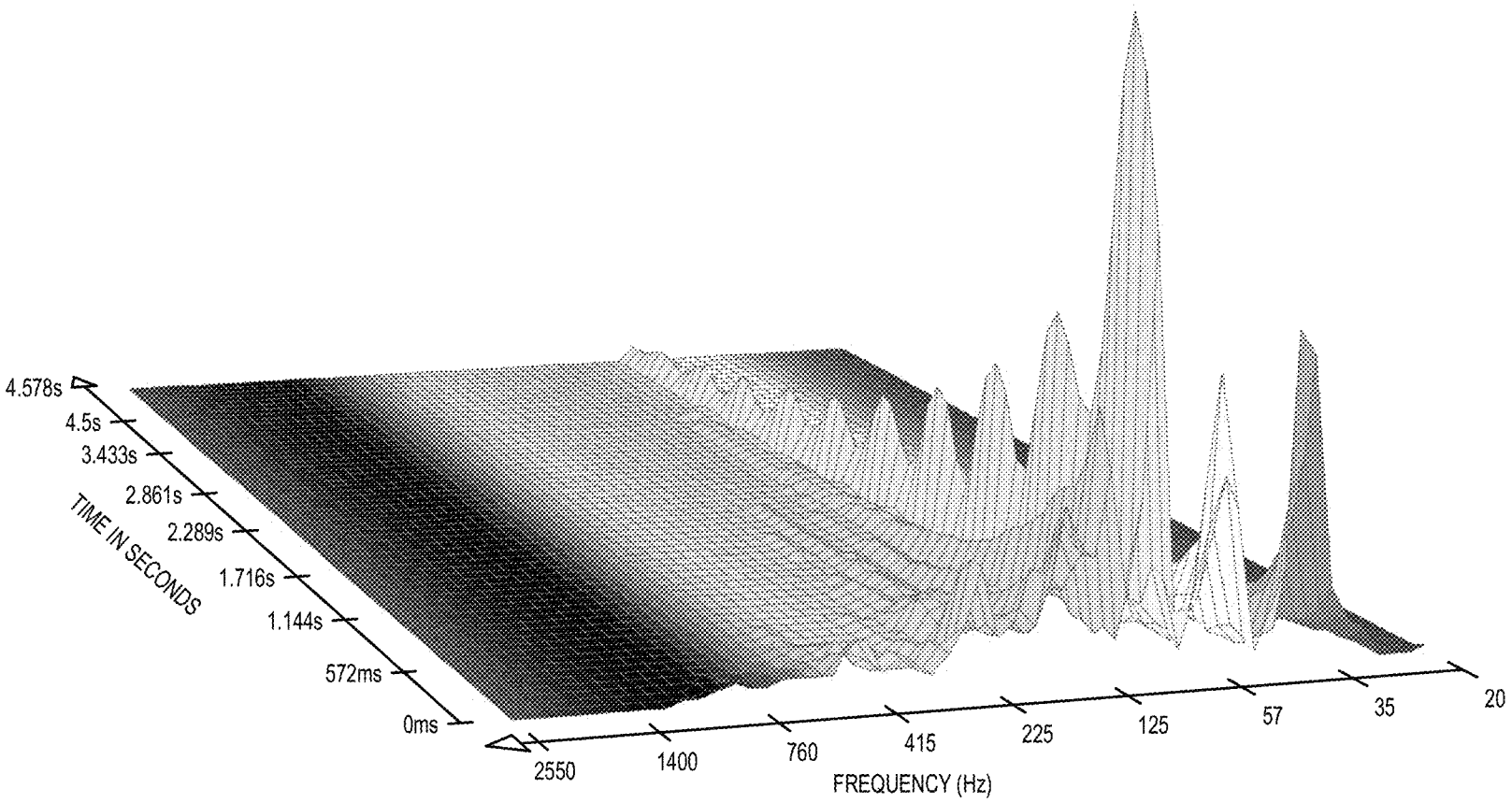
FIG. 24 is a spectrum analysis demonstrating the effects of film flutter on the peripheral edge of the ported opening according to one embodiment of the present invention.
Figure 25:
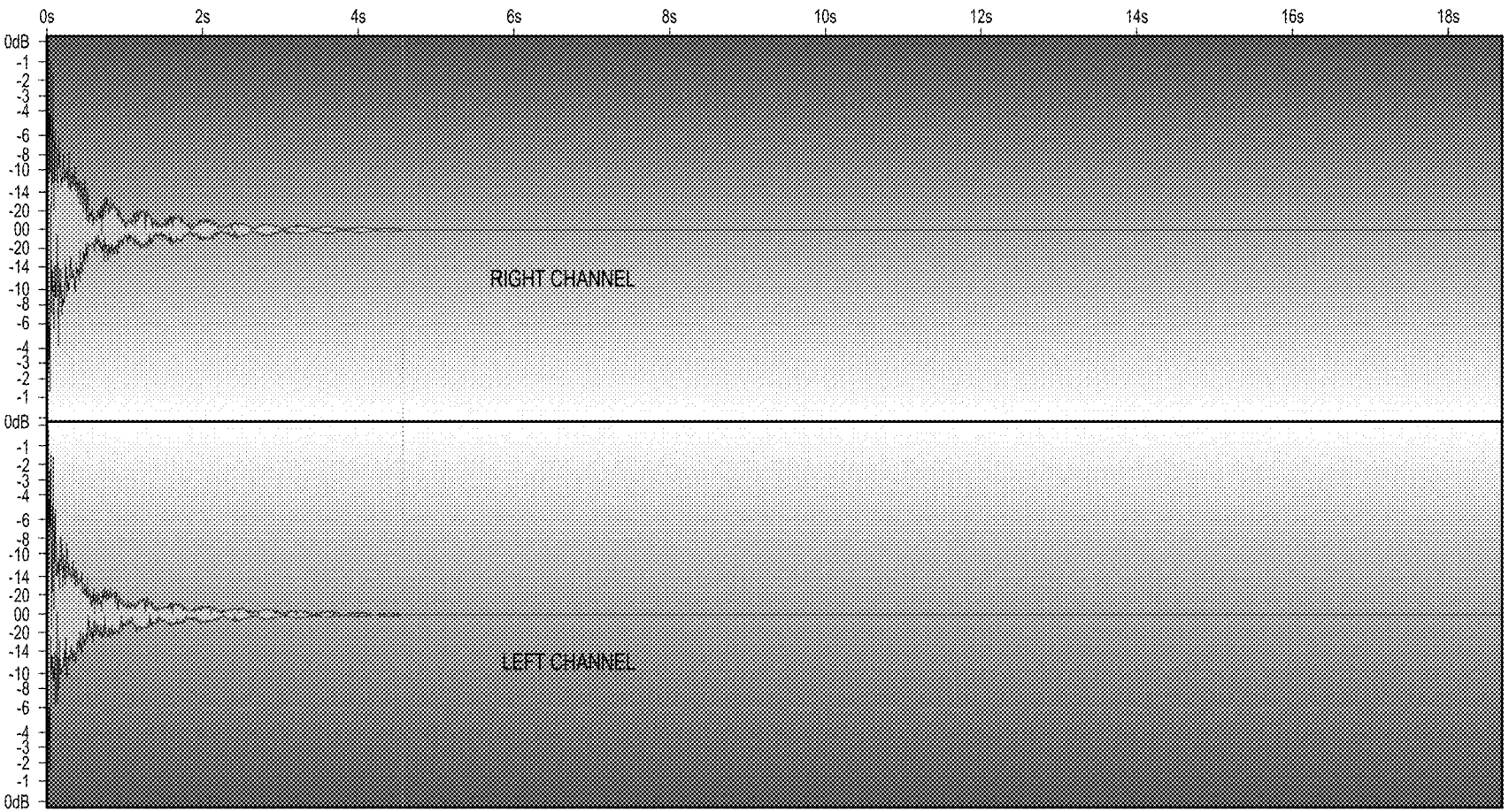
FIG. 25 is a wave form view demonstrating the effects of film flutter on the peripheral edge of the ported opening according to one embodiment of the present invention.
Figure 26:
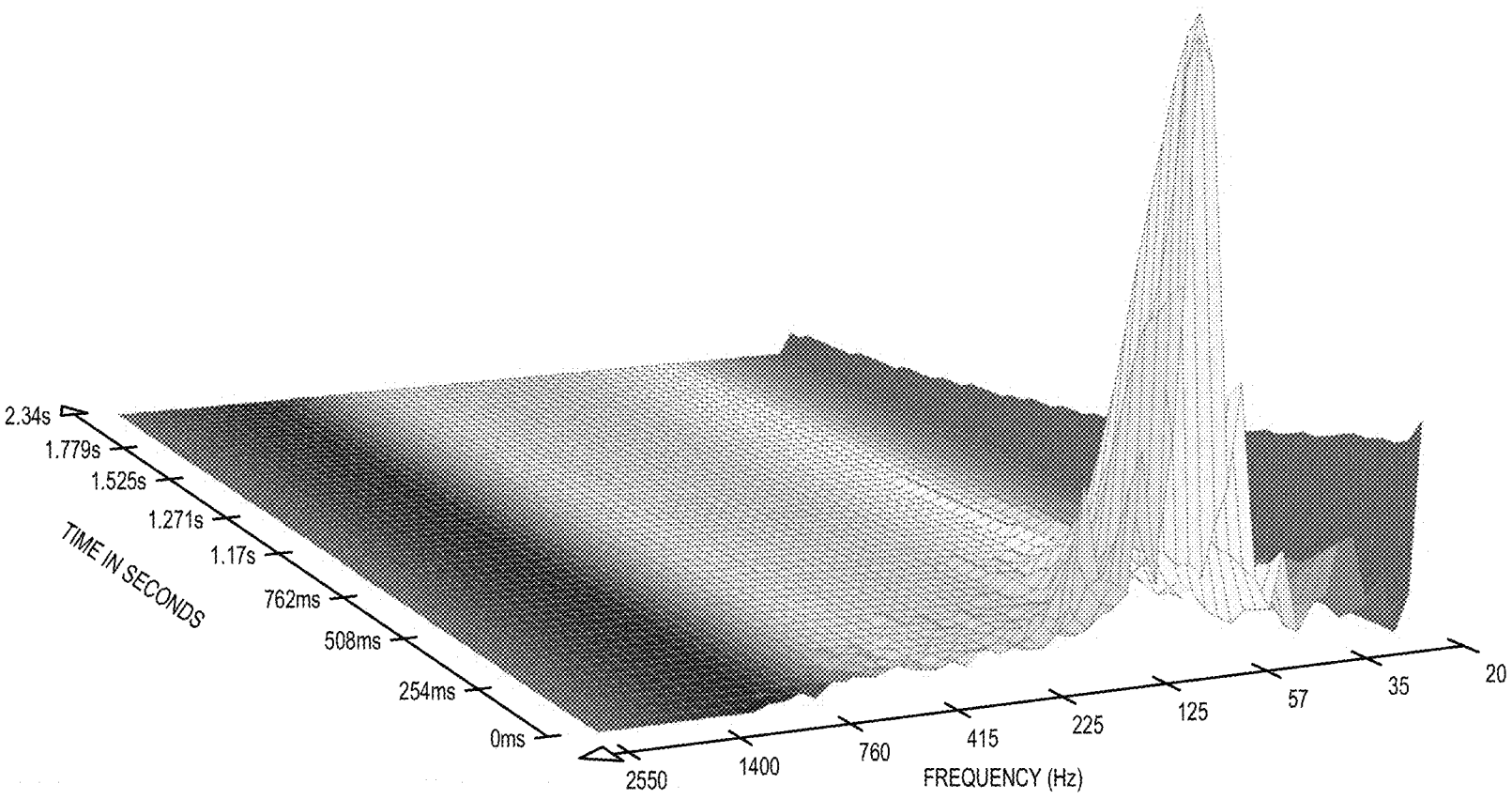
FIG. 26 is a spectrum analysis demonstrating the effects of the absence of film flutter on the peripheral edge of the ported opening when one embodiment of the device according to the present invention is secured to the resonant drumhead.
Figure 27:
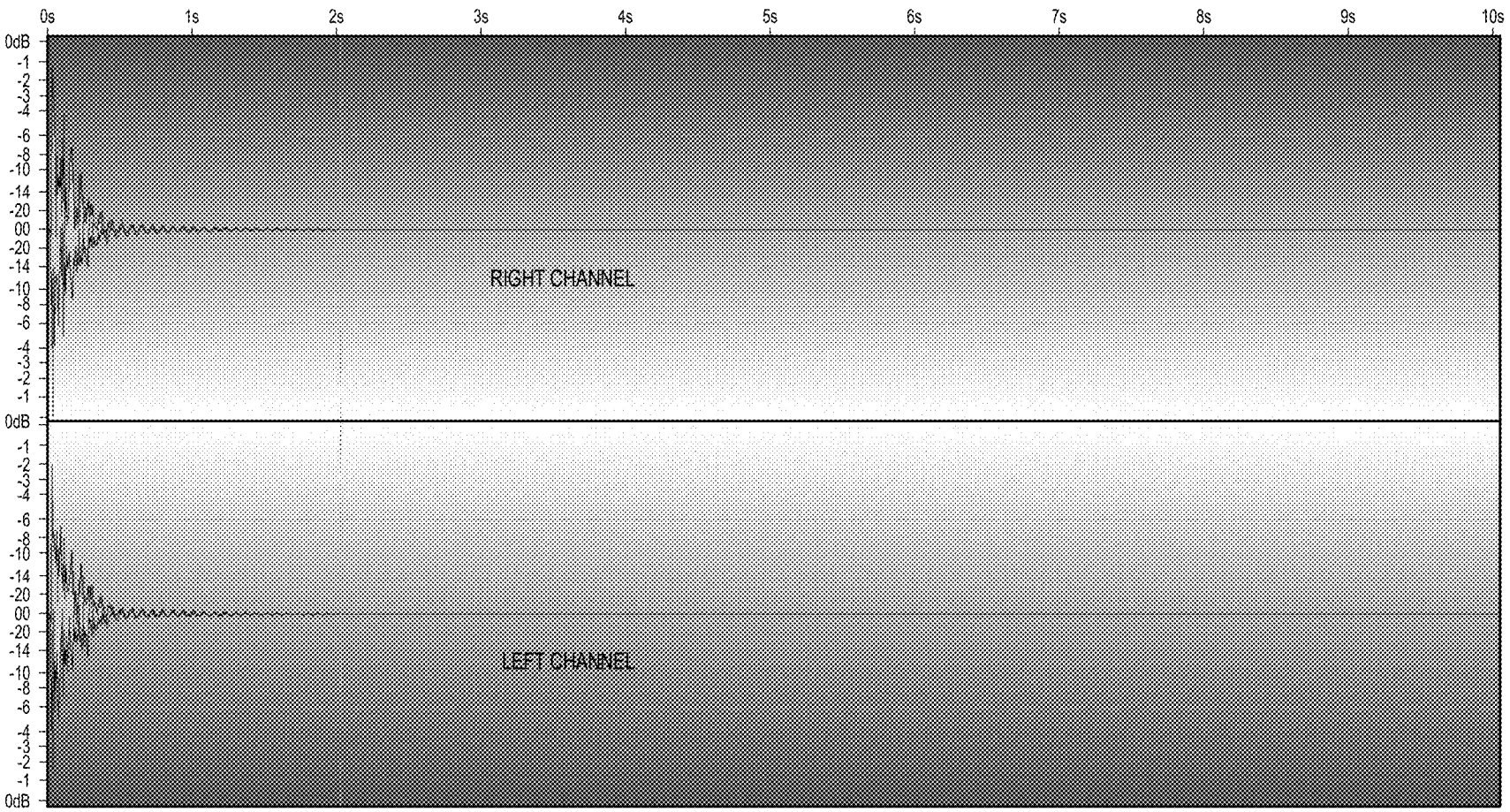
FIG. 27 is a wave form view demonstrating the effects of the absence of film flutter on the peripheral edge of the ported opening when one embodiment of the device according to the present invention is secured to the resonant drumhead.
Figure 28:
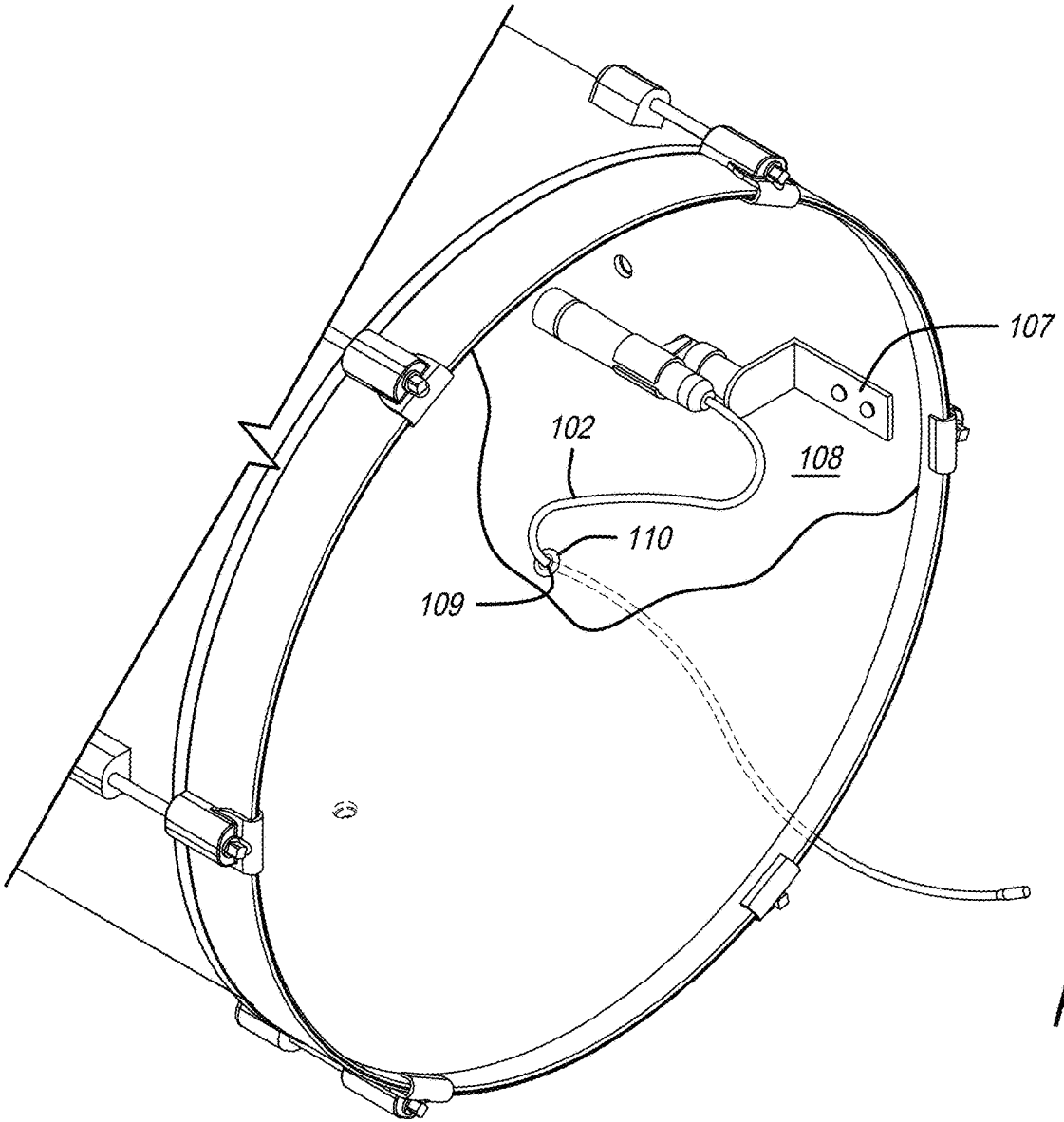
FIG. 28 is a perspective view of a microphone support assembly attached to the inside of a conventional drumshell and supporting a microphone as taught by the prior art.
Figure 29:
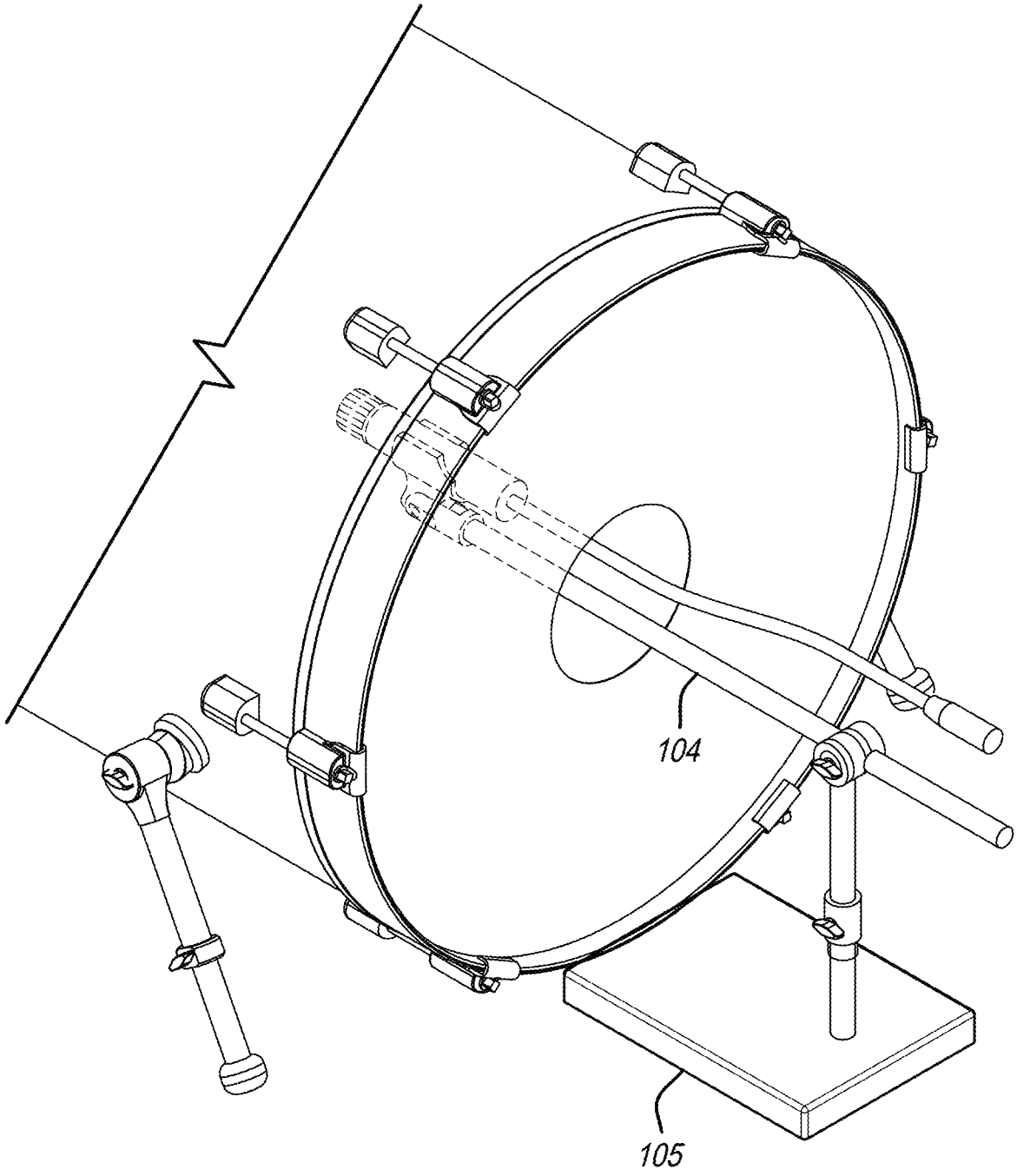
FIG. 29 is a perspective view of the resonant drumhead attached to a drumshell with a microphone supported by a support assembly attached to a conventional boom arm and boom stand positioned forward of the drumhead as taught by the prior art.

FIG. 21 illustrates a spectrum analysis of the effect of high-frequency film flutter by a 5-inch ported opening in a 22-inch bass drumhead. FIG. 22 illustrates the waveform view of the effects of high-frequency film flutter by a 5-inch ported opening in a 22-inch bass drumhead. FIG. 23 illustrates a spectrum analysis depicting the absence of high-frequency film flutter with the same drumhead. FIG. 24 is the waveform view illustrating the effect of the absence of high-frequency film flutter with the same drumhead.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. In a musical bass drum including a hollow drum shell with an interior, said drum shell having a first opening and a second opening, a batter drumhead covering said first opening and a resonant drumhead covering said second opening, said resonant drumhead having a back side, a front side and a ported opening through which vibrating air produced upon the striking of said batter head flows, the improvement comprising:

a means fixed to said back side of said resonant drumhead for varying the amount of vibrating air passing through said ported opening to control undesirable higher frequency drum sounds.

2. The musical bass drum of claim 1 wherein said means fixed to said back side of said resonant drumhead for varying the amount of vibrating air passing through said ported opening comprises a device integrally joined with said ported opening, said device having a movable door member adapted to be vertically disposed upwardly and downwardly for varying the size of said ported opening.

3. The musical bass drum of claim 2 wherein said device comprises an assembly of integrated components including a back side plate member, a clamping plate member, said clamping plate member having both a back and a front side, said front side having a plurality of fixed spaced-apart boss members, each of said boss members having a corresponding opening, and a gasket member, said movable door member being positioned and secured in between said back side plate member and said clamping plate member in slidable engagement, said back side plate member and said clamping plate member being joined in fixed relation.

4. The musical bass drum of claim 3 wherein said device joined with said ported opening is abuttingly positioned against said back side of said resonant drumhead, said boss members being positioned to engage the rim of said ported opening for centering said device within said ported opening.

5. The musical bass drum of claim 3 wherein said device is secured to said resonant drumhead by a clamping ring member adapted to engage said device from said front side of said resonant drumhead, said clamping ring member having a plurality of openings for receiving means to engage said corresponding openings in each of said boss members of said clamping plate member for affixedly mounting and securing said device to said resonant drumhead.

6. The musical bass drum of claim 2 comprising a means to move said movable door member vertically.

7. The musical bass drum of claim 6 wherein said means to move said movable door member vertically comprises a rigid structure integrally formed with said movable door member.

8. The musical bass drum of claim 6 wherein incremental vertical movements of said movable door member vary the amount of said vibrating air vented through said ported opening.

9. The musical bass drum of claim 2 wherein said movable door member in a completely open position allows for the maximum amount of vibrating air to pass through said ported opening.

10. The musical bass drum of claim 2 wherein said movable door member in a completely closed position prevents vibrating air from passing through said ported opening.

11. The musical bass drum of claim 3 wherein said back side plate member and said clamping plate member are secured by a means for controlling the amount of slide tension applied to said movable door member as said movable door member is moved vertically between said back side plate member and said clamping plate member.

12. The musical bass drum of claim 11 wherein said means for controlling the amount of slide tension comprises a plurality of mated threaded fasteners and nuts adapted to positionally adjust the spacing between said back side plate member and said clamping plate member to increase or decrease the amount of said slide tension.

13. The musical bass drum of claim 5 wherein said means for engaging said corresponding openings comprises a plurality of threaded fasteners, each of said threaded fasteners being matingly engaged with a threaded nut.

14. The musical bass drum of claim 3 wherein said back side plate member includes a plurality of boss members, each of said boss members having a corresponding opening, and said clamping plate member includes a plurality of openings, each of said openings being adapted to receive a threaded fastener for engaging a mated threaded nut in each of said openings formed within said corresponding boss member to affixedly join said back side plate member and said clamping plate member.

15. The musical bass drum of claim 5 comprising a means for mounting a microphone within said interior of said drumshell.

16. The musical bass drum of claim 15 wherein said means for mounting a microphone includes a half-ring member having at least three openings and a microphone support member, said microphone support member having a threaded aperture at one end and a threaded portion formed circumferentially at the opposite end, said clamping ring member including at least two openings and a first notch conformed for receiving said microphone support member, and a second notch, and one or more said threaded fasteners for engaging one or more of said openings in said half-ring member with corresponding aligned said openings in said clamping ring member adapted for affixedly mounting said half-ring member to said clamping ring member, each of said opening in said clamping ring member having a mating threaded nut for engaging a corresponding threaded fastener.

17. The musical bass drum of claim 16 wherein said back side plate member, said clamping plate member, and said gasket member individually include, respectively, said upper-positioned notches and said lower-positioned notches adapted to align in corresponding relation with said first notch and said second notch of said clamping ring member to enable said microphone support member with or without said microphone to pass through into said interior of said drumshell.

18. The musical bass drum of claim 17 wherein said microphone support member is inserted with or without said microphone through said first notch of said clamping ring member and aligned with said lower-positioned notches into said interior of said drumshell.

19. The musical bass drum of claim 18 wherein said microphone is supported within said interior of said drumshell by a means for tilting said microphone to adjust the drum sound vibrations pick-up capability of said microphone.

20. The musical bass drum of claim 17 wherein a shim member having a lower-positioned first notch, an upper-positioned second notch and an upper bearing edge is disposed insertably between said back side plate member and said clamping plate member, said lower-positioned first notch of said shim member in aligned relation with each of said respective lower-positioned notches formed within said back side plate member, said clamping plate member, and said gasket member being adapted for receiving said microphone support member and said upper-positioned second notch of said shim member in aligned relation with each of said lower-positioned notches formed within said back side plate member, said clamping plate member and said gasket member adapted for receiving an electric cord attached to said microphone.

21. The musical bass drum of claim 20 wherein said shim member when inserted between said back side plate member and said clamping plate member enables said microphone support member and said cord to pass through said ported opening into said interior of said drumshell whereby said movable door is brought down upon said upper bearing edge in contact relation to a substantially closed position.

22. The musical bass drum of claim 3 wherein said gasket member is constructed of a foam material.

23. The musical bass drum of claim 3 wherein said gasket member is constructed of a synthetic material.

24. The musical bass drum of claim 3 wherein said gasket member is constructed of a rubber material.

25. The musical bass drum of claim 3 wherein said back side plate member, said clamping plate member, said gasket member and said movable door member, or any of said members individually, are constructed of a synthetic material.

26. The musical bass drum of claim 3 wherein said back side plate member, said clamping plate member, said gasket member and said movable door member, or any of said members individually, are constructed of a polyethylene material.

27. The musical bass drum of claim 3 wherein said back side plate member, said clamping plate member, said gasket member and said movable door member, or any of said members individually, are constructed of a metal alloy.

28. The musical bass drum of claim 15 wherein means for mounting a microphone within said interior of said drumshell includes a conventional boom arm with said microphone attached at one end disposed through said ported opening into said interior of said drumshell.

* * * * *